US006155169A

United States Patent [19]

Kacmarcik et al.

[11] Patent Number: 6,155,169

[45] **Date of Patent: *Dec. 5, 2000**

[54] METHOD FOR PRINTING BINGO BOOKS

[75] Inventors: Thomas J. Kacmarcik, North Ridgeville; John L. Rogaliner, South Euclid; Louis E. Mixon, Jr., Amherst, all of Ohio

[73] Assignee: Arrow International, Inc., Cleveland, Ohio

[ * ] Notice: This patent is subject to a terminal disclaimer.

[21] Appl. No.: 09/249,708

[22] Filed: Feb. 12, 1999

Related U.S. Application Data

[62] Division of application No. 08/792,103, Jan. 31, 1997, abandoned, and a continuation of application No. 08/367,790, Dec. 30, 1994, abandoned.

[51] Int. Cl.[7] ..... B41M 1/14; B41F 5/16; B41F 5/18; B41F 1/10; B41F 13/02

[52] U.S. Cl. ..... 101/211; 101/181; 101/219; 101/490; 101/DIG. 48

[58] Field of Search ..... 101/181, 178, 101/175, 176, 177, 179, 180, 182, 216–218, 483, 484, 485, DIG. 48, 136, 137, 138, 139, 211, 219, 490; 270/1.01; 283/114

[56] References Cited

U.S. PATENT DOCUMENTS

| | | | |
|---|---|---|---|
| 614,809 | 11/1898 | Henkle . | |
| 1,586,915 | 6/1926 | Pendergast . | |
| 1,989,375 | 1/1935 | Meyercord | 101/DIG. 48 |
| 2,343,880 | 3/1944 | Brownlee . | |
| 3,280,737 | 10/1966 | Huck | 101/219 |
| 3,421,752 | 1/1969 | Folino . | |
| 3,427,655 | 2/1969 | Woodside . | |
| 3,822,876 | 7/1974 | Frain . | |
| 3,883,130 | 5/1975 | Hardesty . | |
| 3,956,049 | 5/1976 | Johnsen . | |
| 3,963,173 | 6/1976 | Stone | 229/45 R |
| 3,998,446 | 12/1976 | Dent . | |
| 4,033,611 | 7/1977 | Johnsen . | |

(List continued on next page.)

FOREIGN PATENT DOCUMENTS

| | | | |
|---|---|---|---|
| 0018147 | 10/1980 | European Pat. Off. | 101/177 |

OTHER PUBLICATIONS 3 pages of 1987 Arrow International, Inc. catalog concerning Starburst paper (numbered R100043–45).
Schematic view of Arrow printing press (circa 1987).
Enlarged schematic view of Starburst belt print unit of printing press of Document AJ (circa 1987).
Blueprint concerning four color belt Cameron pringint machine (pre–1994).
Copy of UNIMAX paper prototype (6 pgs).
Schematic view of printing press employed to print the UNIMAX paper prototype of Document AJ.
Enlarged schematic view of a short belt printing press employed with the belt press arrangement of Document AK.

*Primary Examiner*—Kimberly Asher
*Attorney, Agent, or Firm*—Fay, Sharpe, Fagan, Minnich & McKee, LLP

[57] ABSTRACT

A method of printing on a web of paper includes the steps of providing the web, adjusting a tension on the web and sequentially printing each of a plurality of different indicia on defined sequential longitudinally spaced printing fields of the web. Information is then printed in each of the defined printing fields on the web. Preferably, the method is used for printing bingo game booklets in which each sheet of the booklet is identified by a different color or border than is each other sheet in the booklet. The apparatus includes a roll stand from which the web is fed and an indicia printing unit. The indicia printing unit includes a plurality of indicium rolls supported by and spaced around a frame and an endless printing belt supported by the rolls, the printing belt having a plurality of sequentially longitudinally spaced print areas. The endless printing belt is looped around a register cylinder and an impression cylinder is provided around which a paper web is looped as the web is brought into contact with the endless printing belt to print a sequence of different printing fields, each designated by a different indicium from each adjacent printing field on the paper web. A first control system automatically regulates which portions of the belt contact which of the indicium rolls and in what sequence.

29 Claims, 18 Drawing Sheets

U.S. PATENT DOCUMENTS

| | | | |
|---|---|---|---|
| 4,270,774 | 6/1981 | Barnes . | |
| 4,408,525 | 10/1983 | Rebel . | |
| 4,448,127 | 5/1984 | Frain . | |
| 4,463,677 | 8/1984 | Kuehfuss . | |
| 4,628,816 | 12/1986 | Six . | |
| 4,669,729 | 6/1987 | Solitt . | |
| 4,785,734 | 11/1988 | Kawana et al. | 101/219 |
| 4,824,503 | 4/1989 | Wilen . | |
| 4,854,232 | 8/1989 | Oda . | |
| 4,856,429 | 8/1989 | Lauber . | |
| 4,882,688 | 11/1989 | Kondziolka et al. . | |
| 4,885,700 | 12/1989 | Kondziolka et al. . | |
| 5,085,417 | 2/1992 | Copham . | |
| 5,353,703 | 10/1994 | Rieker | 101/177 |
| 5,489,091 | 2/1996 | Greer et al. . | |
| 5,607,145 | 3/1997 | Lovell . | |
| 5,779,274 | 7/1998 | Gallagher, Jr. et al. . | |
| 5,890,432 | 4/1999 | Rogaliner et al. | 101/483 |

126
127
70
80
78
D
68
52
56
28
14
50
54
82
100
C
4E
4E
102

METHOD FOR PRINTING BINGO BOOKS

This application is a divisional of U.S. patent application Ser. No. 08/792,103 dated Jan. 31, 1997, now abandoned. That application, in turn, is a file wrapper continuation of U.S. patent application Ser. No. 08/367,790 filed on Dec. 30, 1994 and now abandoned.

BACKGROUND OF THE INVENTION

The present invention is directed to the printing arts. More particularly, this invention is directed to a method of printing on a paper web and a manufacturing system which includes flexographic, letter press and dry offset printers.

The invention is particularly applicable to the printing of booklets of bingo sheets. However, it should be appreciated by those of average skill in the art that the method and apparatus disclosed herein could also be employed for printing a variety of other types of printed matter, including checks, business forms or advertising brochures.

It has now become popular in the playing of bingo to purchase a booklet of bingo sheets which each have one or more bingo faces printed thereon. These booklets comprise multiple sheets of bingo paper, one stacked upon the other, with the paper sheets being glued at one edge to form a booklet. The number of sheets in a booklet is indicated by the term "up." Thus a 10 UP booklet means a booklet having ten sheets. Each sheet typically contains a number of bingo faces indicated by the term "ON." These can range from a 1 ON to a 36 ON, or more. A respective one of these sheets is played, one at a time, during a bingo game. When a player arrives at the bingo hall, he purchases one or more booklets. Each booklet contains one sheet for each game of the evening. The player would then play all of the bingo faces on the first sheet for the first game and mark these sheets with an ink marker, or ink dauber, as each of the numbers is called. Once a winner is declared and the game is over, the player merely removes the top sheet from the booklet and plays the next game on the second sheet. The marked first sheet is discarded.

As bingo has become more popular, bingo games have included as many as one thousand players, each one using twelve, eighteen or more bingo faces simultaneously, on anywhere from twenty to thirty games. A bingo hall operator can thus use up over 400,000 bingo faces in a single night.

Since a large number of people usually play bingo at the same time, it is highly desirable that each of the persons playing bingo have different non-duplicative bingo faces on their sheets in order to reduce the possibility that more than one person would win at the same time by having the identical bingo face. Therefore, it is desirable to be able to print a large number of different bingo faces on bingo sheets in order to reduce the occurrence of prize-splitting.

A security problem also exists with bingo sheets. Players have been known to attempt to cheat in a particular bingo game by bringing in bingo paper from another game or from a prior session. The player would then claim to win by declaring a bingo on a sheet of paper not purchased at the beginning of the bingo session, or not the sheet then being played in the stack of sheets. It would be advantageous, therefore, to allow a bingo hall operator to provide maximum game integrity and security so as to prevent such manipulation.

Currently, each booklet in a stack of bingo game booklets available for sale before a bingo session, is separated from the adjacent booklets by a sheet of wax paper. This enables the operator to readily detach each booklet from the stack for sale. However, wax paper adds to the weight of the stack of booklets. From the perspective of the bingo game operator, it would be desirable to reduce the weight of stacks of bingo game booklets distributed before each game. This would result in easier handling of the stacks of bingo game booklets by the operators of the bingo hall, as well as lessening the freight costs and scrap or waste paper.

A difficulty with currently manufactured bingo game booklets is that no bingo game printing apparatus currently exists which allows a bingo paper manufacturer to print a plurality of bingo sheets, wherein the bingo faces on different sheets are identified by different indicia but the bingo sheets have a common identifying numeral on each bingo face of each sheet. The only way that a manufacturer can currently produce such a product is by separately printing the bingo sheets with different indicia and a common identification number and then hand collating these sheets into bingo game booklets. Obviously, this is a disadvantageous, slow and expensive technique. It is also difficult to ensure that each and every booklet has exactly the same sequence of sheets when the booklet contains a large number of sheets, such as, e.g. twenty to thirty or more sheets.

Accordingly, it has been considered desirable to develop a new and improved method and apparatus for printing on a web of paper which would overcome the foregoing difficulties and others while providing better and more advantageous overall results.

BRIEF SUMMARY OF THE INVENTION

The present invention relates to a method of printing on a web of paper.

More particularly, the present invention comprises the steps of providing a web of paper, adjusting a tension on the web of paper and sequentially printing each of a plurality of different indicia on defined sequential longitudinally spaced printing fields of the web of paper. Information is then printed in each of the defined printing fields on the web of paper.

Preferably the step of printing information comprises the subsidiary steps of printing a first designation in each of the defined printing fields on the web of paper and printing a matrix of alpha numeric characters in each of the defined printing fields on the web of paper. The method can further comprise the step of printing a second designation on preselected ones of the defined sequential areas on the web of paper. The method can comprise the further step of applying a glue repellent coating to at least portions of preselected ones of the defined sequential areas on the web of paper.

Preferably the step of sequentially printing each of a plurality of indicia comprises the subsidiary steps of printing a first pattern sequentially in each of a plurality of colors and subsequently printing a second pattern sequentially in each of a plurality of colors. The method can further comprise the step of subsequently printing a third pattern in each of a plurality of colors. The method can further comprise the step of printing in a first pattern and then printing in a second pattern. If desired, the method can further comprise the step of cutting the web into predetermined lengths after the step of subsequently printing information.

The present invention also relates to a printing system which enables the printing of different indicia sequentially on a web of paper.

More particularly, the printing system comprises a roll stand from which the web is fed and an indicia printing unit. The indicia printing unit comprises a plurality of image transfer rolls supported by and spaced around a frame, an endless printing belt supported by the rolls, the printing belt having a plurality of sequentially longitudinally spaced print areas, a register cylinder around which said endless printing belt is looped and an impression cylinder around which a paper web is looped as the web is brought into contact with said endless printing belt to print a sequence of different printing fields, each designated by a different indicium from each adjacent printing field on the paper web. The system further comprises a control means for automatically regulating which portions of said belt contact which of said indicium rolls and in what sequence.

The apparatus can, if desired, further comprise a first printing unit for printing a first string of information on the paper web and a second control means for automatically regulating the operation of a first printing unit so that only preselected ones of the printing fields are printed on by the first printing unit. If desired, the apparatus can further comprise a coating unit for applying a glue resistant coating to the paper web and a third control means for automatically regulating which preselected ones of the printing fields of the paper web will receive the glue resistant coating. The apparatus can further comprise a web tensioner, which includes an infeed drum rotatably mounted on a frame, at least one set of pull wheels for holding the paper web against the drum and a means for varying the speed of rotation of the infeed drum.

If desired, the indicia printing unit can further comprise a web tensioning roll, a housing in which the web tensioning roll is rotatably mounted, a support stand on which the housing is held, a first means for translating the housing on the support stand and a second means for rotating the web tensioning roll. If desired, the indicia printing unit can further comprise a means for driving the register cylinder and the impression cylinder and a means for coupling a speed of the web tensioning roll to a speed of the register cylinder. The indicia printing unit can further comprise a means for adjusting a speed of the tensioning roll to a speed of the register cylinder.

One advantage of the present invention is the provision of a new and improved method and apparatus for printing.

Another advantage of the present invention is the provision of a method of printing which enables a printer to sequentially print different indicia on defined sequential longitudinally spaced areas on a web of paper while at the same time printing a common first designation in each of the defined areas on the web of paper.

Still another advantage of the present invention is the provision of a method for printing which allows one to sequentially print a plurality of bingo matrix indicia on defined sequential longitudinally spaced areas on a web of paper, print bingo matrices in each of the defined areas on the web of paper and print a common identifying numeral in each of the defined sequential areas on the web of paper. The provision of a common identifying or tracking serial number on each bingo face on each sheet of a set of sheets, which is collated into a booklet, provides maximum security to the game by enabling the proprietor of the game to easily stop a player from declaring a bingo when using paper from another game.

Yet another advantage of the present invention is the provision of a method for printing bingo game booklets in which a web of paper is sequentially printed with bingo matrix identifiers in each of a plurality of colors or patterns in defined discrete areas of the web and a common identifying numeral is printed in each of the discrete areas of the web so that when the web is cut into bingo sheets which are assembled into a booklet, each page of the booklet will have a common indicium which is different from the common indicia on any other page of the booklet. Preferably, all the booklets in a set are collated to have the same sequence of indicia. This arrangement enables floor workers in a bingo hall to make sure that everyone is on the same page during a game.

Still another advantage of the present invention is the provision of a method for printing a plurality of booklets, each comprising a collated set of sheets wherein the plurality of booklets are separated from one another by a wax coating applied on the top sheet of each booklet. The wax coating eliminates the need for a wax sheet conventionally used between the bingo game booklets. This results in less weight and waste paper per carton of bingo booklets, easier handling and lower freight costs.

Yet still another advantage of the present invention is the provision of a method for printing consecutive audit numbers on each top sheet of each bingo game booklet in a stack of such booklets. This simplifies the tracking of sales and inventory and allows the game proprietor to maintain reliable accounting records.

A further advantage of the present invention is the provision of a method for printing bingo game booklets in which the bingo matrices on each sheet are identified by an indicium which borders the bingo face such that the numerals of the bingo matrix remain prominently visible. Preferably, borders in different colors and borders having different designs are used as the indicium and a white background is maintained for the bingo matrix so that the numbers in the matrix remain clearly visible.

A still further advantage of the present invention is the provision of a printing apparatus in which defined areas of a printing belt are sequentially brought into contact with each of a plurality of spaced anilox rolls by the movement of each of a plurality of image transfer rolls located adjacent the anilox rolls. A control system selectively moves the image transfer rolls toward and away from the anilox rolls in a sequence depending upon a rotation of an impression cylinder around which a paper web is looped and a register cylinder around which the printing belt is looped. This allows for a very precise printing sequence for the paper web.

Still other advantages of the present invention will become apparent to those skilled in the art upon the reading and understanding of the following detailed specification.

BRIEF DESCRIPTION OF THE DRAWINGS

The invention may take form in certain parts and arrangement of parts a preferred embodiment of which will be described in detail in this specification and illustrated in the accompanying drawings which form a part hereof and wherein.

DETAILED DESCRIPTION OF THE PREFERRED EMBODIMENT

Figure 1:
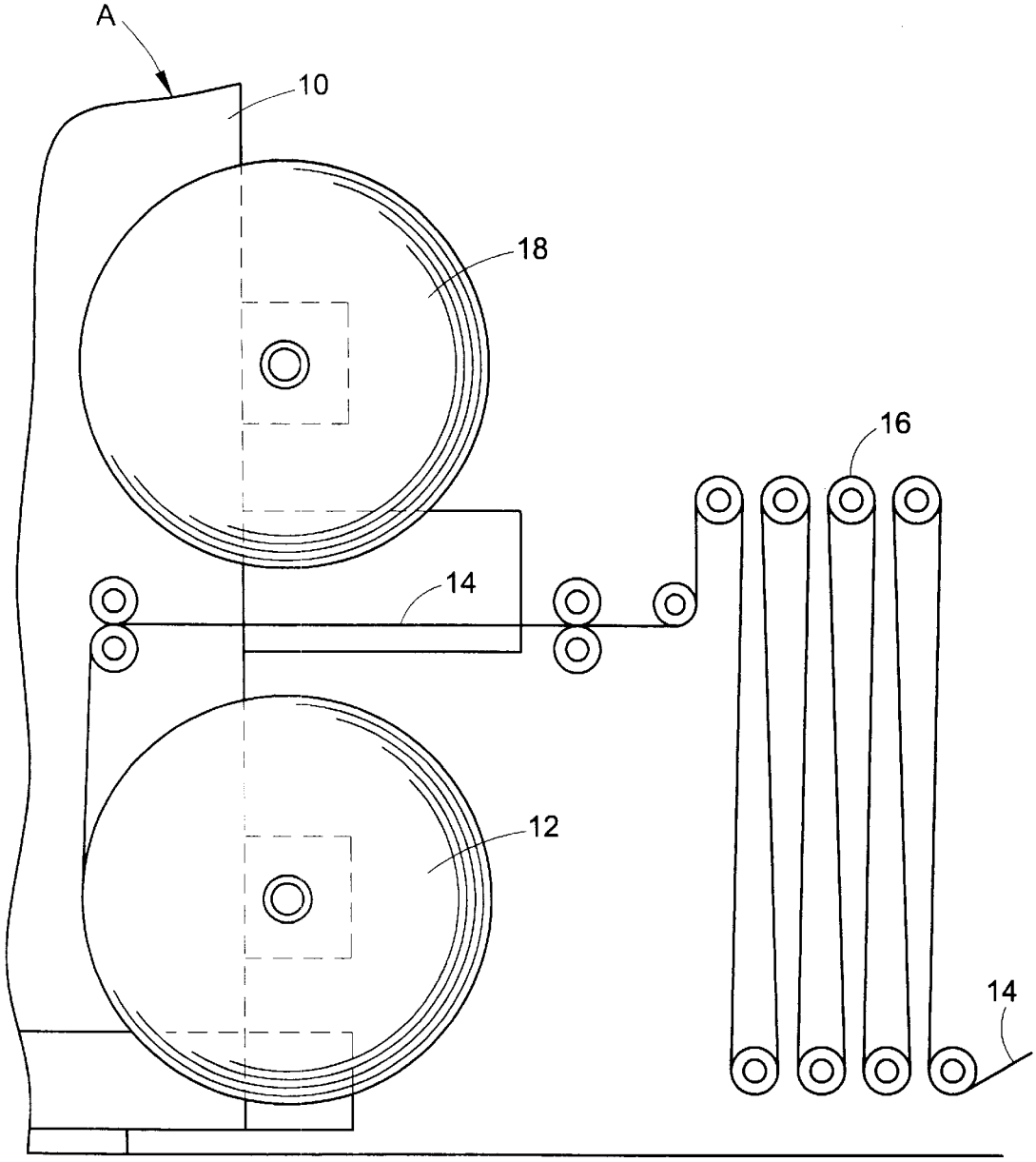
FIG. 1 is a schematic side elevational view of a roll stand of a printing system according to the preferred embodiment of the present invention.
Figure 2A:
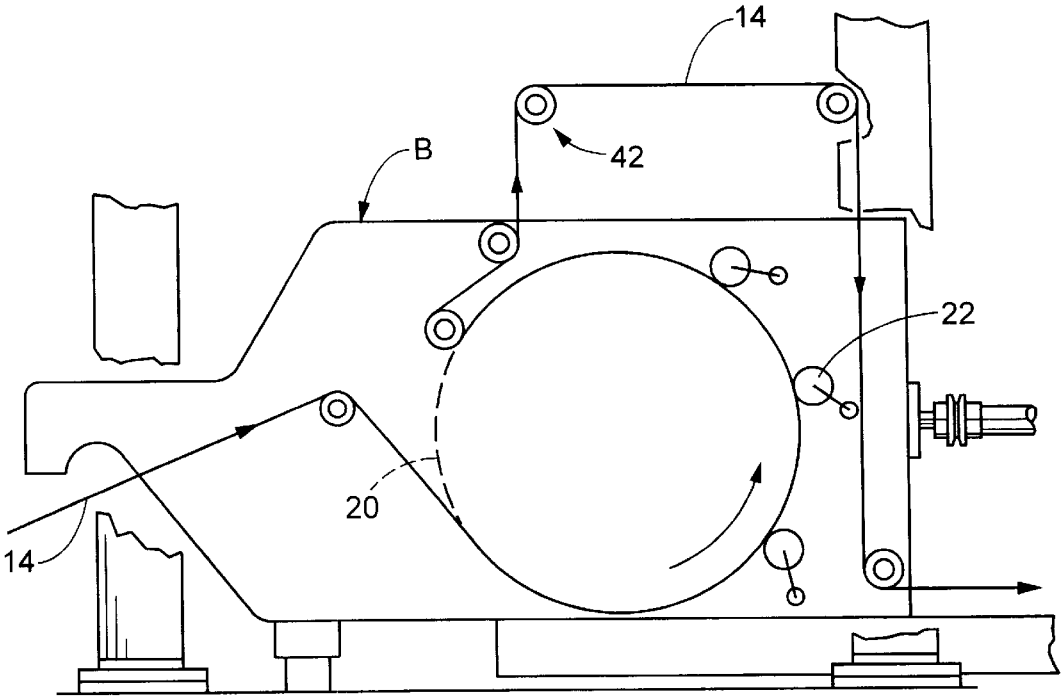
FIG. 2A is a schematic side elevational view of an infeed unit of the printing system.
Figure 3:
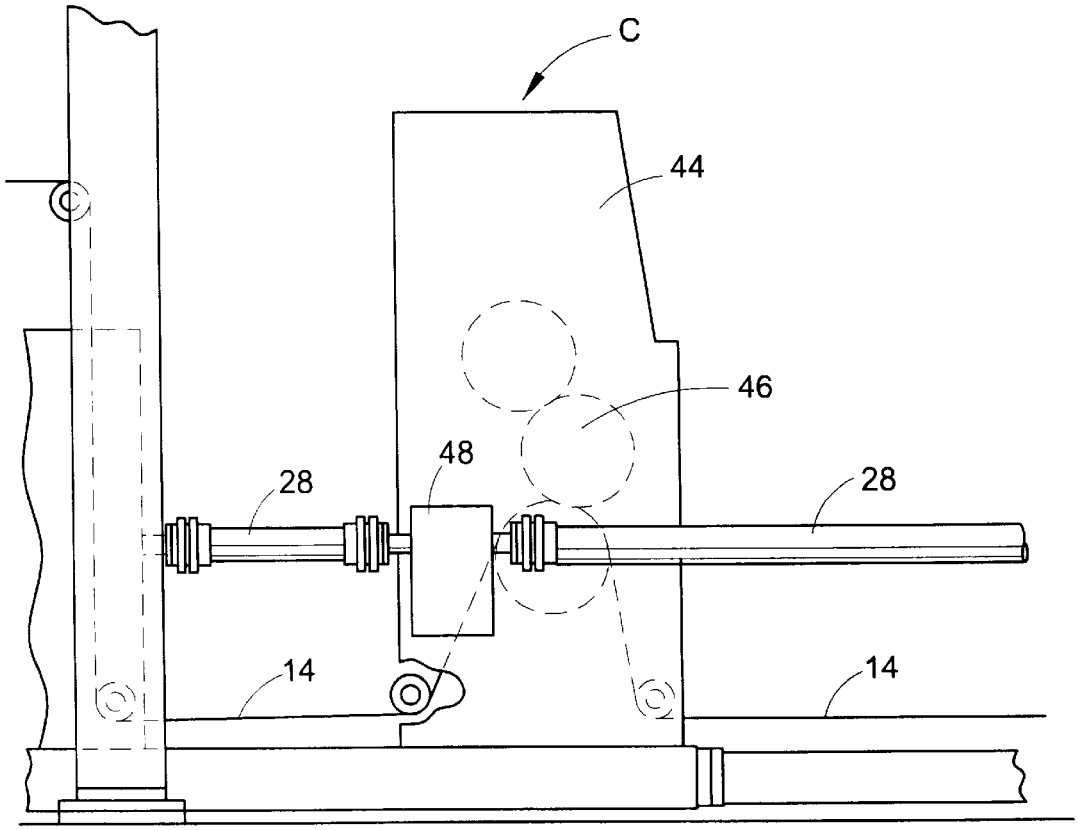
FIG. 3 is a schematic side elevational view of a fixed data print unit of the printing system according to the present invention.
Figures 4A, 4C:
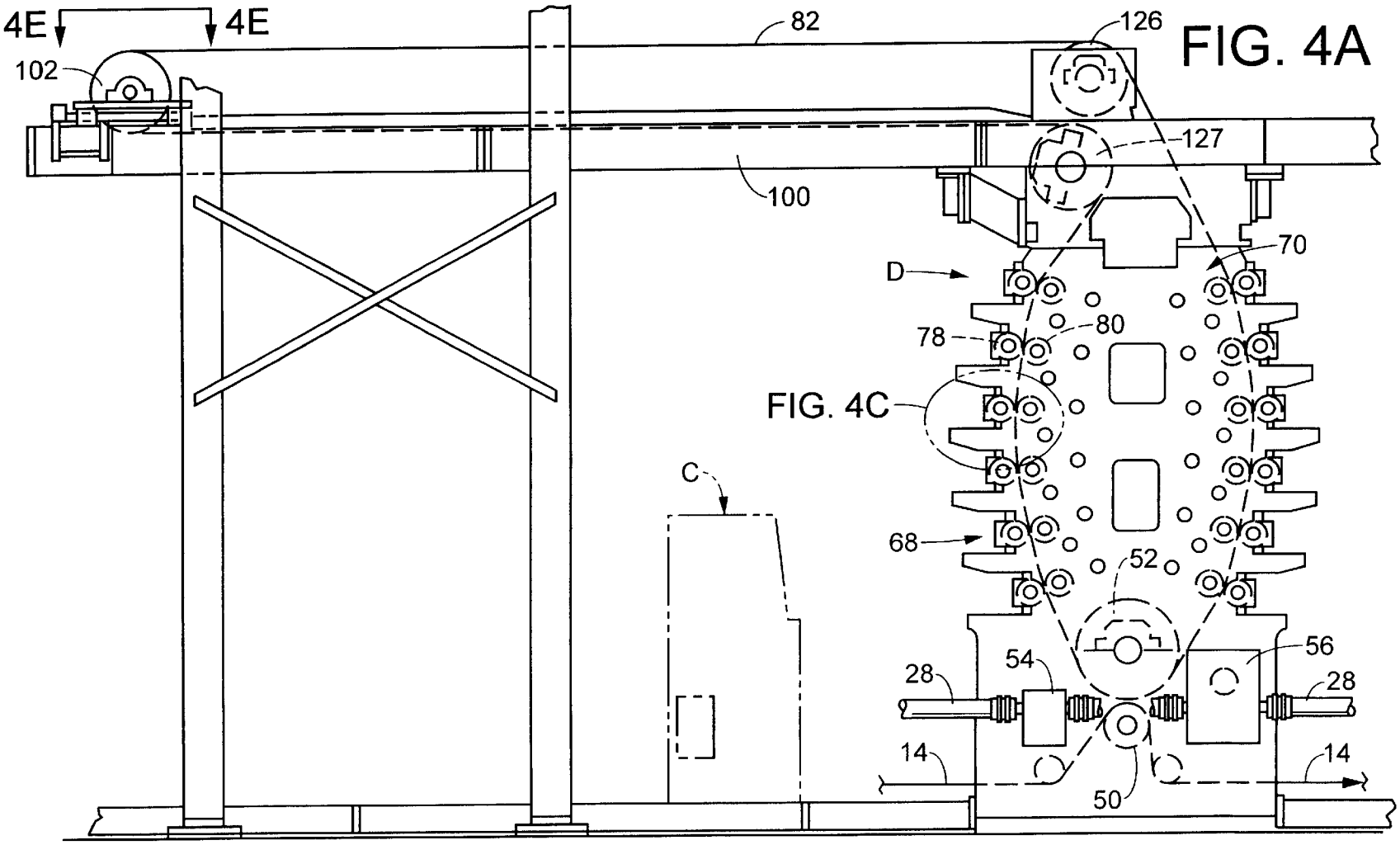
FIG. 4A is a schematic side elevational view of a border print unit of the printing system according to the present invention.
FIG. 4C is an enlarged side elevational view of one of a plurality of inking units of the border print unit of FIG. 4A.
Figure 5A:
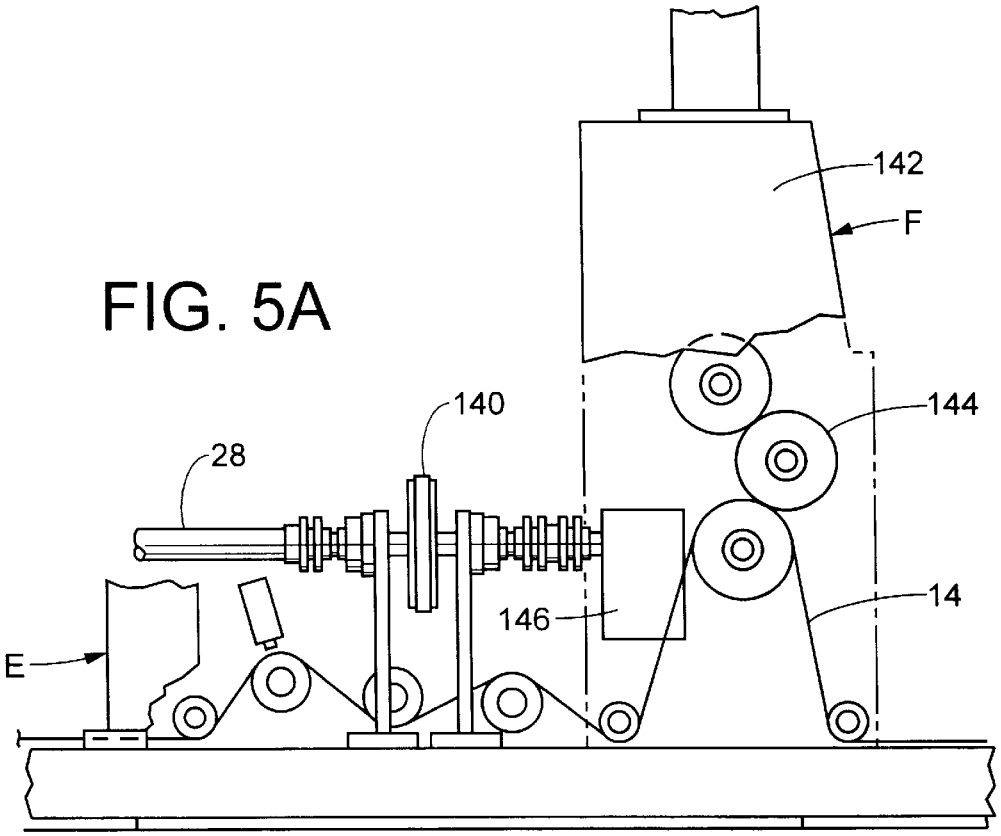
FIG. 5A is a schematic side elevational view of an audit number print unit and a custom print unit for the printing system according to the present invention.
Figure 6A:
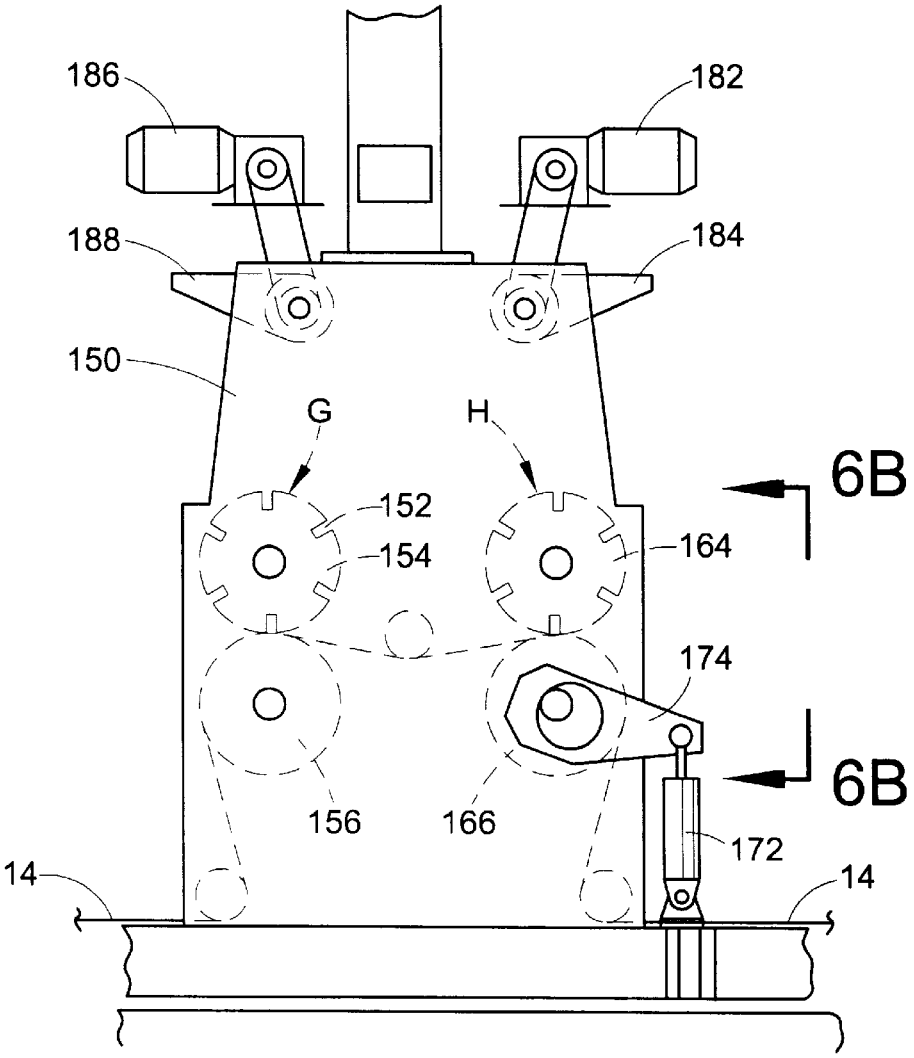
FIG. 6A is a schematic side elevational view of a numbering unit and a wax unit of the printing system according to the present invention.
Figure 7:
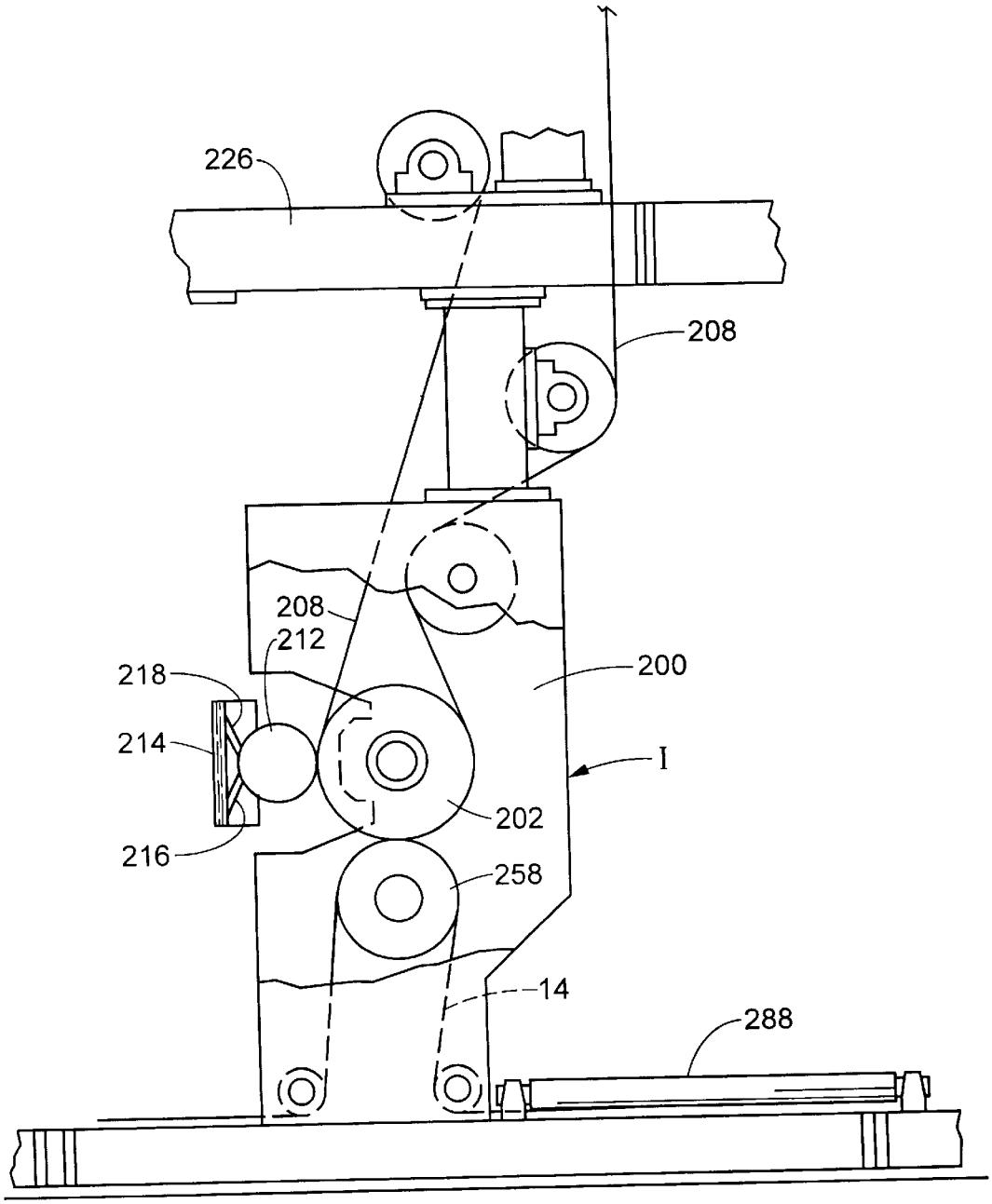
FIG. 7 is a schematic side elevational view of a portion of a bingo face print unit of the printing system according to the present invention.
Figure 12:
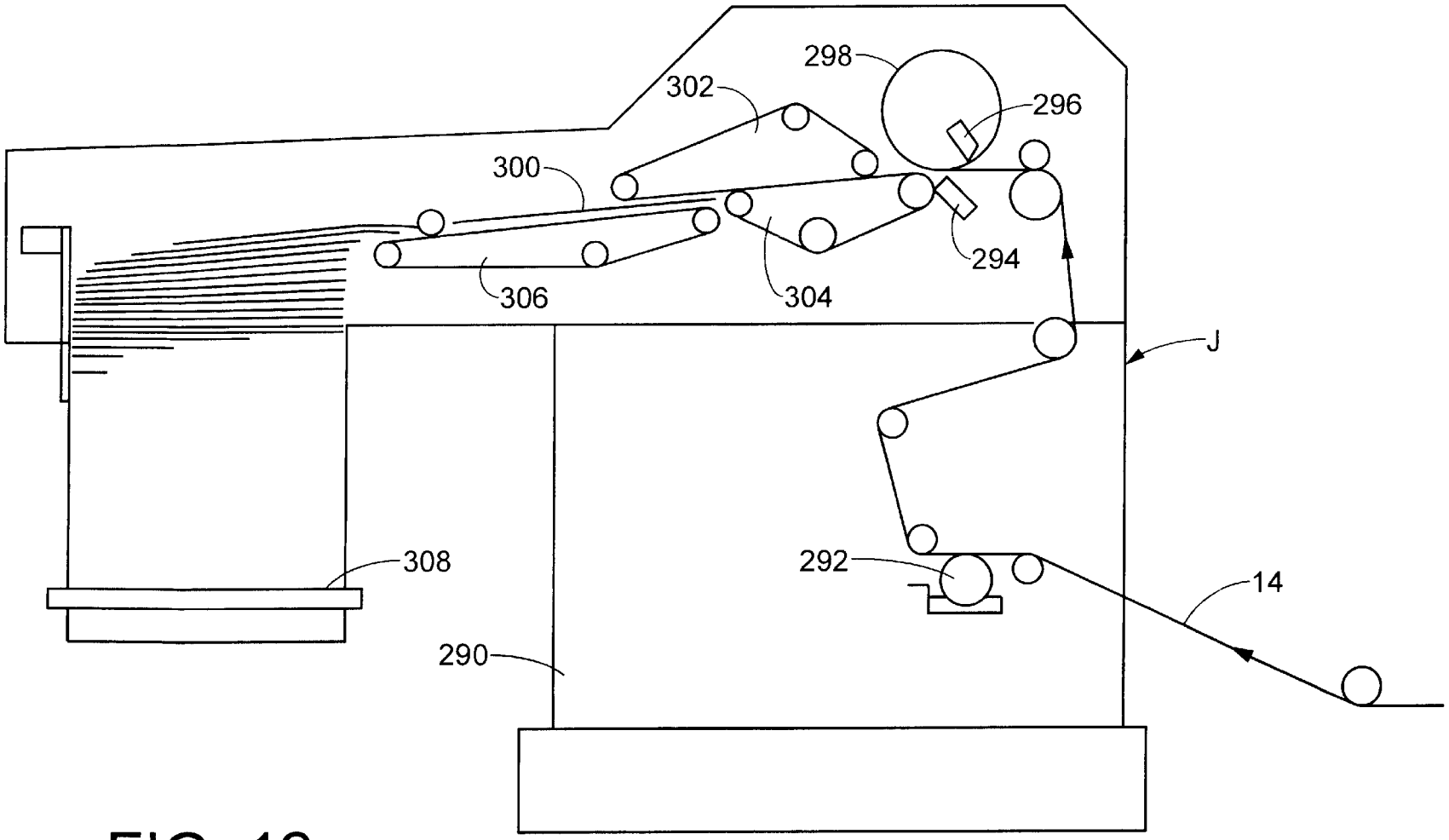

Referring now to the drawings wherein the showings are for purposes of illustrating a preferred embodiment of the present invention and not for purposes of limiting same, a printing system according to the present invention comprises a roll stand A, as illustrated in FIG. 1, which feeds a paper web to an infeed unit B, as illustrated in FIG. 2A, then to a fixed data print unit C, as illustrated in FIG. 3, and then to a border print unit D, as illustrated in FIG. 4A. The web is thereafter fed to an audit number print unit E and a custom print unit F, as illustrated in FIG. 5A, then to a numbering unit G and a wax unit H, as illustrated in FIG. 6A, and then to a bingo face print unit I, as illustrated in FIG. 7, and finally to a cutting unit J, as illustrated in FIG. 12. While the printing system is primarily designed for and will hereinafter be described in connection with the manufacture of-bingo game sheets, it will be appreciated that the apparatus could also be used in various other printing environments.

With reference now to FIG. 1, the roll stand A comprises a frame 10 on which is rotatably supported a first roll 12 which feeds a paper web 14 through a storage festoon 16. A second roll 18 is prepared while the web from the first roll is running. After passing through the storage festoon 16, the web 14 is fed to the infeed unit B illustrated in FIG. 2A. The infeed unit B comprises a large diameter infeed drum 20 and a plurality of sets of pull wheels 22 which hold the web 14 against the drum. The drum 20 can have a diameter of approximately four and one half times the sheet cutoff length of the web and may, if desired, be chrome plated. The speed of the infeed drum 20 is variable in order to provide a fine adjustment for obtaining the proper web tension through the press.

Figure 2B:
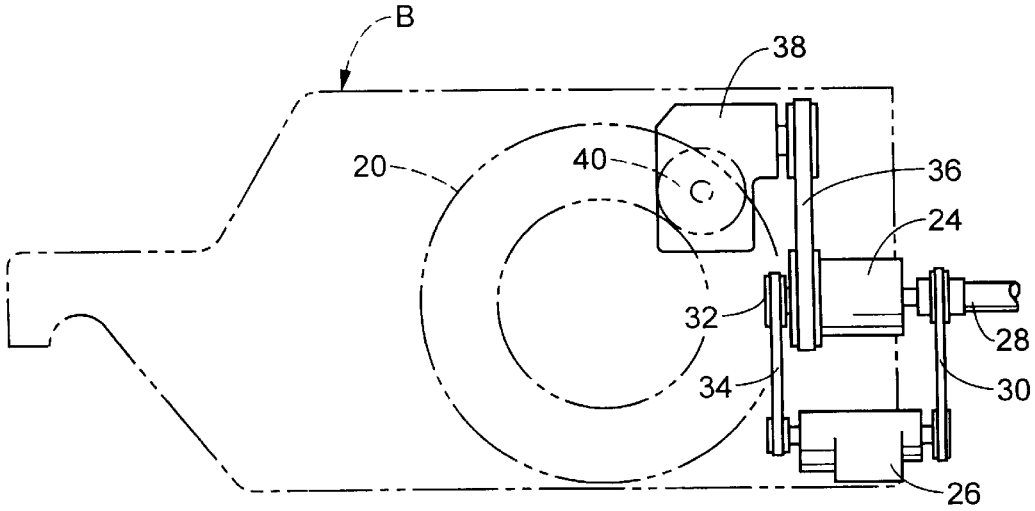
FIG. 2B is a schematic side elevational view of the infeed unit of FIG. 2A.

With reference now to FIG. 2B, a speed adjustment of the infeed drum 20 is made by employing a differential 24 and a variable speed drive 26. The differential 24 drives the infeed drum 20 at near press speed because the differential is itself powered by a main line shaft 28. A takeoff belt 30 from the main line shaft drives the variable speed drive 26 which then drives a trim shaft 32 of the differential 24 via a belt 34. The trim shaft 32 gives a fine adjustment to the output of the differential 24 and, therefore, the infeed drum. A timing belt 36 connects the differential 24 to a gear box 38 having therein a gear drive 40 that drives the drum 20. The web 14, after passing around the infeed drum 20, passes through a conventional web aligner 42 and then goes on to the fixed data print unit C.

With reference now to FIG. 3, the fixed data print unit C comprises a housing 44 in which is located a conventional offset printing unit 46 which is powered from the main line shaft 28 via a gear box 48. Fixed data can be, e.g., a copyright or patent notice, manufacturer name or the like. The web 14, after passing through the fixed data print unit C, goes to the border print unit D.

With reference now to FIG. 4A, the border print unit comprises an impression cylinder 50 around which the paper web 14 is looped, and a register cylinder, or pin cylinder 52. The impression cylinder 50 is driven by the main line shaft 28 via a first right angle gear box 54. The register cylinder 52 is driven by the main line shaft 28 via a second right angle gear box 56.

Figure 4F:
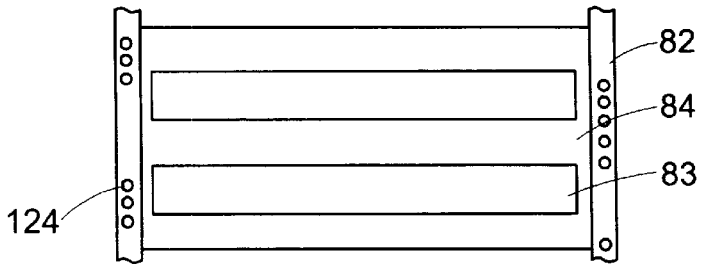
FIG. 4F is an enlarged developed view of a portion of the belt employed with the border print unit of FIG. 4A.
Figure 4B:
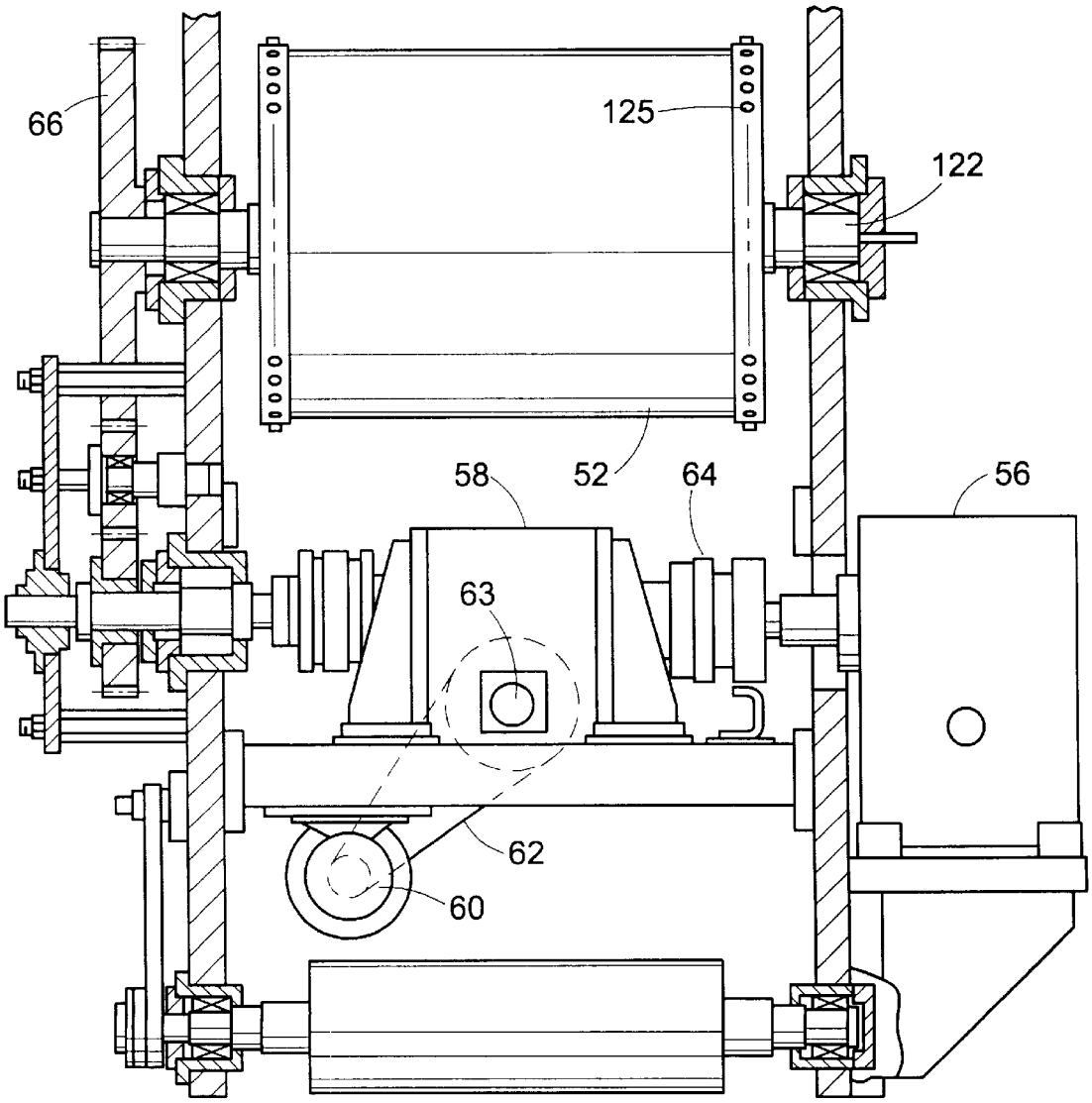
FIG. 4B is an enlarged end elevational view of a register cylinder portion of the border print unit of FIG. 4A.
Figure 4C:
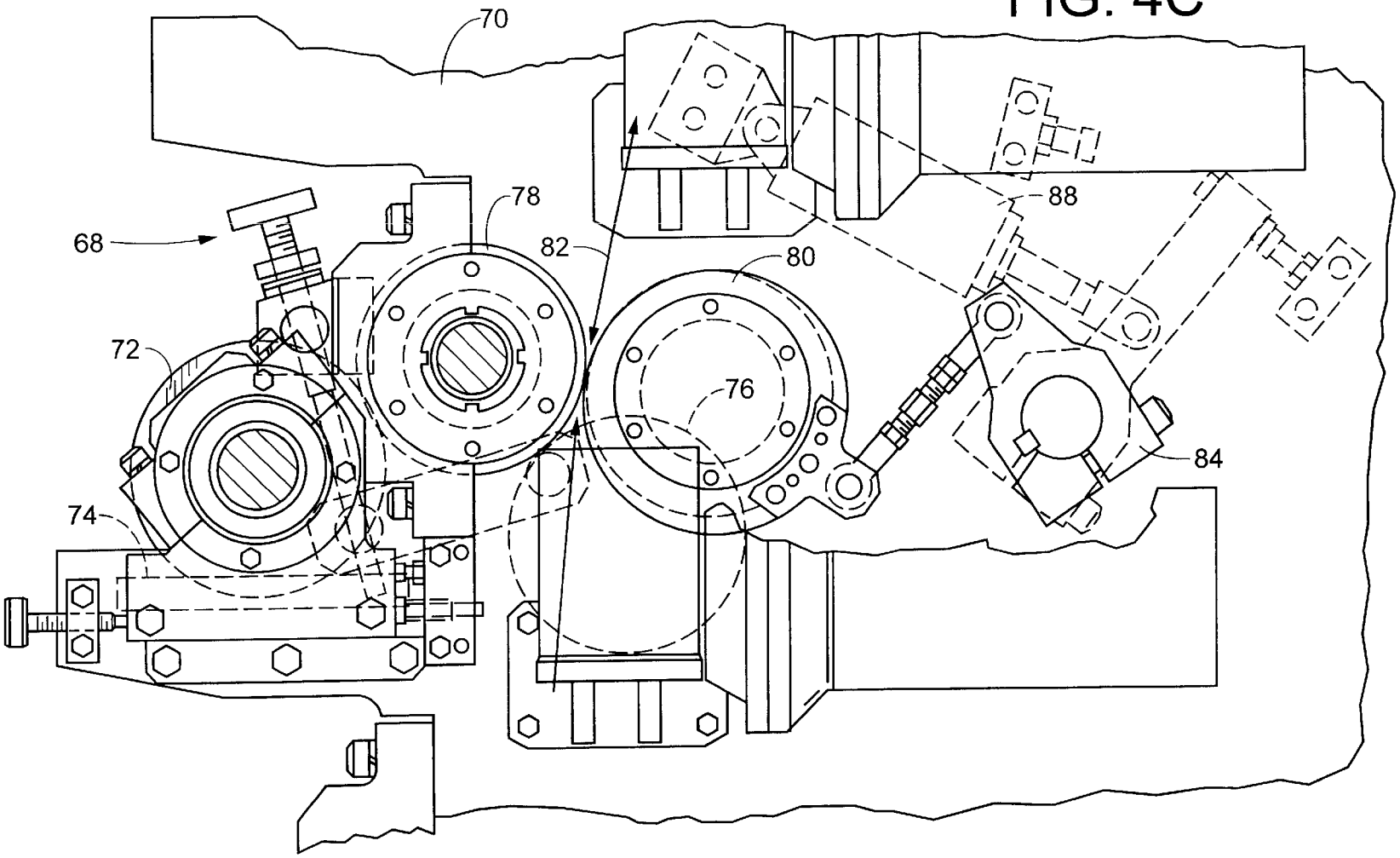

With reference now to FIG. 4B, the register cylinder 52 is driven by the right angle gear box 56 through a planetary differential 58. The function of the planetary differential is to permit a phasing of a border printing belt looped around the register cylinder 52. A two speed reversing motor 60 provides input via a gear belt 62 to an auxiliary shaft 63 of the differential 58. This provides forward and reverse relative motion between the entire border belt print unit D and the rest of the printing press. Between the right angle gear box 56 and the planetary differential 58 there is provided a pneumatic clutch 64 which permits total disengagement of the border print unit from the printing press drive 28, if desired.

Figure 4D:
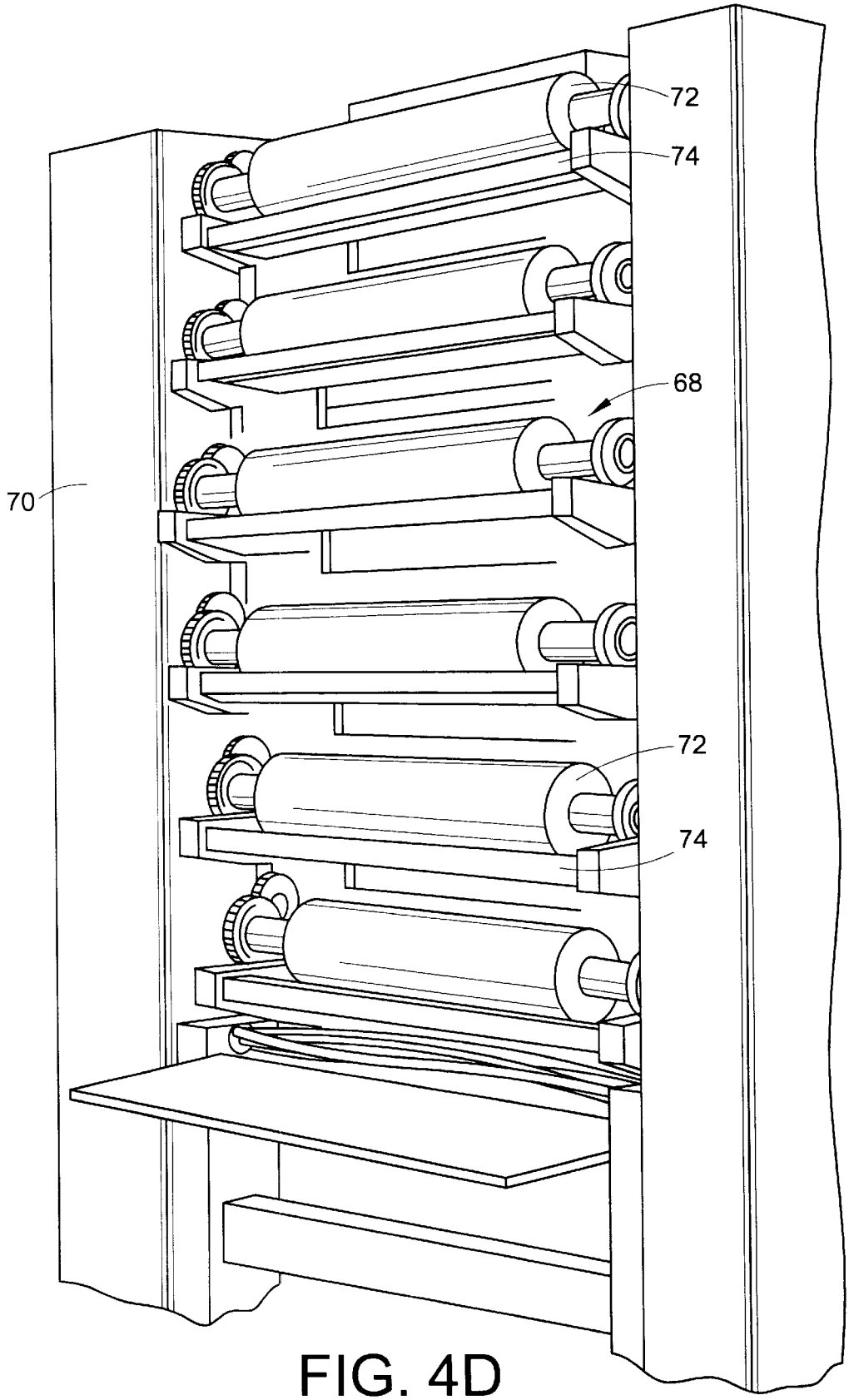
FIG. 4D is an enlarged perspective view of a portion of the border print unit illustrating six inking units.

A gear 66, coupled to the drive system for the register cylinder 52 drives twelve inking stations 68 (one of which is shown in FIG. 4C) housed on a frame 70 of the border print unit, as shown in FIG. 4D through a conventional gear train, (not visible) As can be seen from FIG. 4A, the frame 70 also rotatably supports the register cylinder 52 and the impression cylinder 50. The inking stations are configured symmetrically about the register cylinder 52 such that six of the inking stations are on a roll stand side of the frame 70, and six of the inking stations are on a sheeter side of the frame.

With reference now to FIG. 4C, each inking station 68 comprises a pan roll 72 which draws ink from an adjacent ink pan 74. The ink from the pan roll is transferred to an anilox roll 78 which is mounted in a fixed bore on the frame 70. In contrast, the pan roll has a sliding mount which permits adjustment of the relationship between the pan roll and the anilox roll for proper contact pressure. The anilox roll is provided with two separate drive mechanisms, namely the gear train mentioned previously (not illustrated) and a pan roll drive unit 76 which drives the pan roll through a gear on the anilox roll. While printing, the pan roll runs at a fraction of the speed of the anilox roll. However, when the press is stopped or running at a very low speed, below the surface speed of the pan roll, the anilox roll is driven at the pan roll speed by the pan roll drive unit. Positioned adjacent the anilox roll 78 is an backup roll 80. Located between these two rolls is a printing belt 82 by which the ink is carried to the paper web 14.

As can be best seen from FIG. 4F, the belt 82 includes a plurality of spaced plates 83 which are capable of picking up ink from the several anilox rolls 78, one at each inking station. It should be appreciated that the spaces 84 between the plates 83 do not pick up the ink because of the particular construction of the belt 82. In this connection, the belt is preferably made from a suitable plastic material, such as MYLAR®. The plates 83 can be secured to the belt 82 by any of a plurality of conventional means. One preferred means is double sided tape.

As is evident from FIG. 4C, the backup roll is mounted behind the belt 82 and provides a variable path geometry for the border belt 82. The border belt 82 is moved into and out of contact with the anilox roll 78 for the purpose of inking specific plates 83 on the belt.

The geometry of the six inking stations on each side of the frame 70 forms a large arc, as is illustrated in FIG. 4A, to ensure that there is sufficient wrap of the belt 82 around each of the backup rolls 80 so that when any image transfer roll is moved, the endless belt 82 will follow the roll and pull away from the adjacent anilox roll 78. On the other hand; the arc of the belt 82 cannot be such that when the backup roll 80 is moved away, the belt path length will change drastically and cause gross tension variations in the belt. It has been found by the applicant that a movement of the backup roll 80 of approximately 64/1000ths of an inch is sufficient for this purpose.

In the present invention, the anilox roll remains in a constantly inked condition as it is never separated from the pan roll 72. Therefore, when the plates 83 of the belt 82 are brought back into contact with a respective anilox roll 78 by movement of the backup roll 80, the plates 83 can be instantly inked by the anilox roll 78.

The movement of the backup roll 80 is effected by a series of levers and eccentrics 84. These are actuated by a pneumatic system. With reference now to FIG. 4G, the pneumatic system comprises a solenoid operated air valve 86 which controls the flow of pressurized air to a pair of air cylinders 88 which move the levers and eccentrics 84 of each inking unit. The pneumatic system is controlled by a conventional computer 90 which can include, e.g., an 80386 or an 80486 type microprocessor. The system timing is controlled by the output of a conventional encoder 91 (such as a Dynapar model 625) which is connected to a journal 92 of the impression cylinder 50. Provided on the journal 92 is a flag 93 which triggers a conventional proximity sensor 94 (such as an Allen Bradley model 871C-N8P18 sensor) as the journal rotates, to provide an index pulse to the computer 90. The pulse train from the encoder 91 is used to provide a count in the computer 90 for regulating the movement of the twelve backup rolls 80, one for each inking station. Therefore, twelve such solenoid operated air valves 86 and sets of air cylinders 88 are employed, one for each of the twelve inking stations. The index pulse from the flag 93 provides a reference reading that is compared to the pulse train from the encoder to ensure that extraneous pulses are not induced. Another conventional proximity sensor 96 (such as Pepperell Fuchs model NJ15 sensor) is located adjacent the border belt 82 and senses the presence of a strip of metal tape 97 positioned at a defined location on the belt to provide another index pulse to the computer 90.

Preferably the twelve inking stations 68 each print in a different color. These colors can be, for example, blue, orange, green, yellow, pink, gray, olive, brown, red, purple, black and aqua. While twelve such colors are provided for the inking stations, the belt 82 can have many more than twelve plates 83. For example, the printing belt could have plates which print in a solid border and then plates which print in a striped border and then plates which print in a narrow border. Therefore, it is entirely possible to have a belt which has plates that print in each of the twelve colors with a solid border design, followed by plates which print in each of the twelve colors with a striped border design followed again by plates which print in each of the twelve colors with a narrow border design. This would then result in a belt which can print each of thirty-six different borders, even though only twelve inking stations 68 are provided. It all depends on how many plates 83 are provided on the belt 82.

It should also be appreciated that each of the plates 83 can be as wide as the sheet but the plate is not as long as the sheet which is cut from the web 14. Rather, in the preferred embodiment, six such plates 83 are employed to print a 6 by 6 matrix on each sheet cut from the paper web 14. Therefore, six plates 83 in a row are inked in a first color by a first anilox roll 78 when brought into contact with that anilox roll by the adjacent backup roll 80. This sequence is then continued for the other sections of the belt as the printing belt 82 is conveyed past each of the twelve inking stations 68 mounted on the frame 70. It should be appreciated, however, that the plates 83 could be as long as two or three of the sets of six wide matrices printed on the paper web 14 if so desired.

Because the border printing belt can have plates with different border designs, the belt 82 is considerably longer than the path of the belt around the twelve inking stations 68 held in the frame 70. To this end, the printing belt 82 is looped around a belt support frame 100 (FIG. 4A) which extends away from the inking station frame 70. A belt tensioning unit for the printing belt 82 is mounted on the frame 100.

Figure 4E:
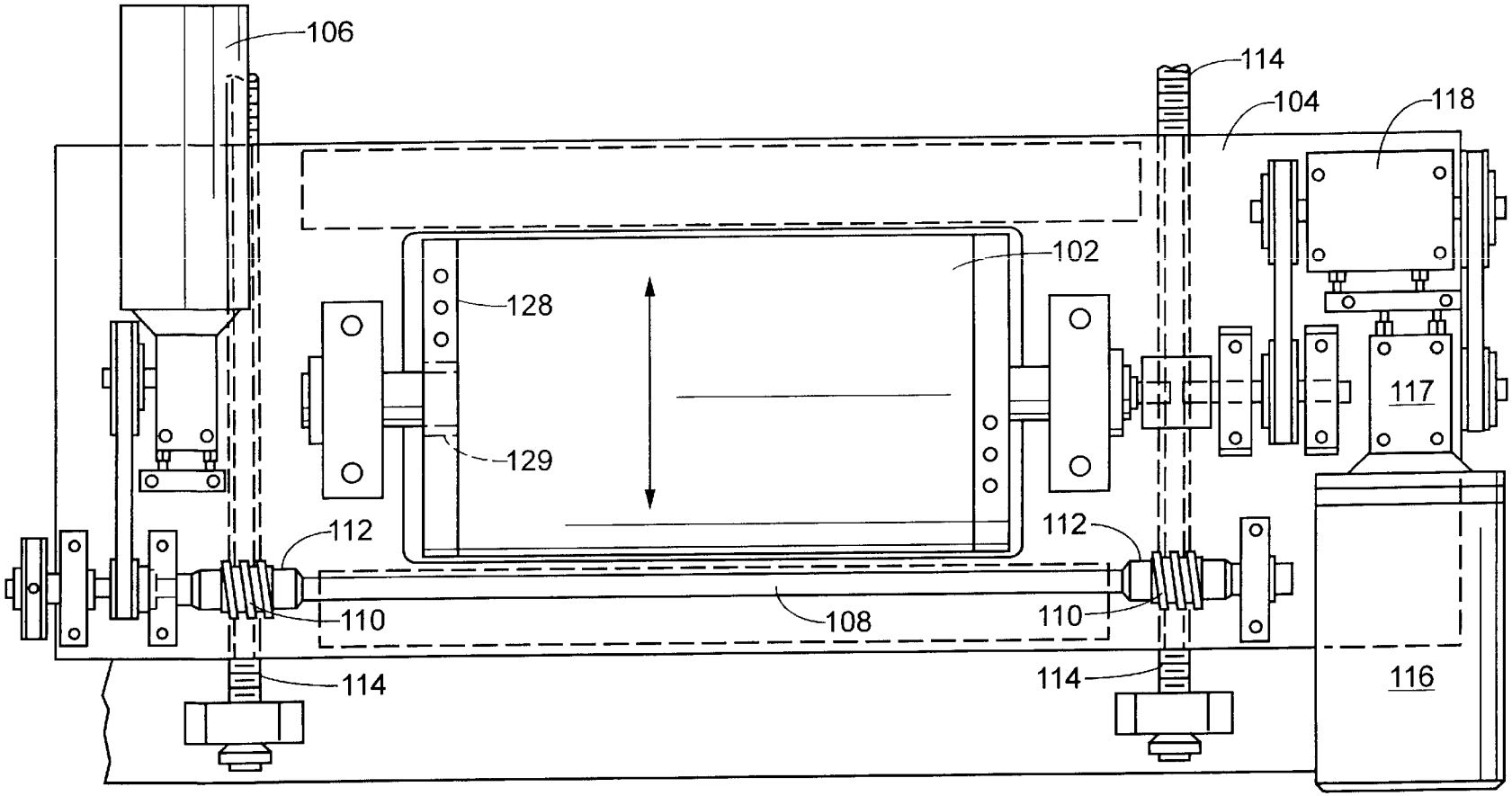
FIG. 4E is an enlarged top elevational view of a belt tensioning unit of the border print unit of FIG. 4A.
Figure 4G:
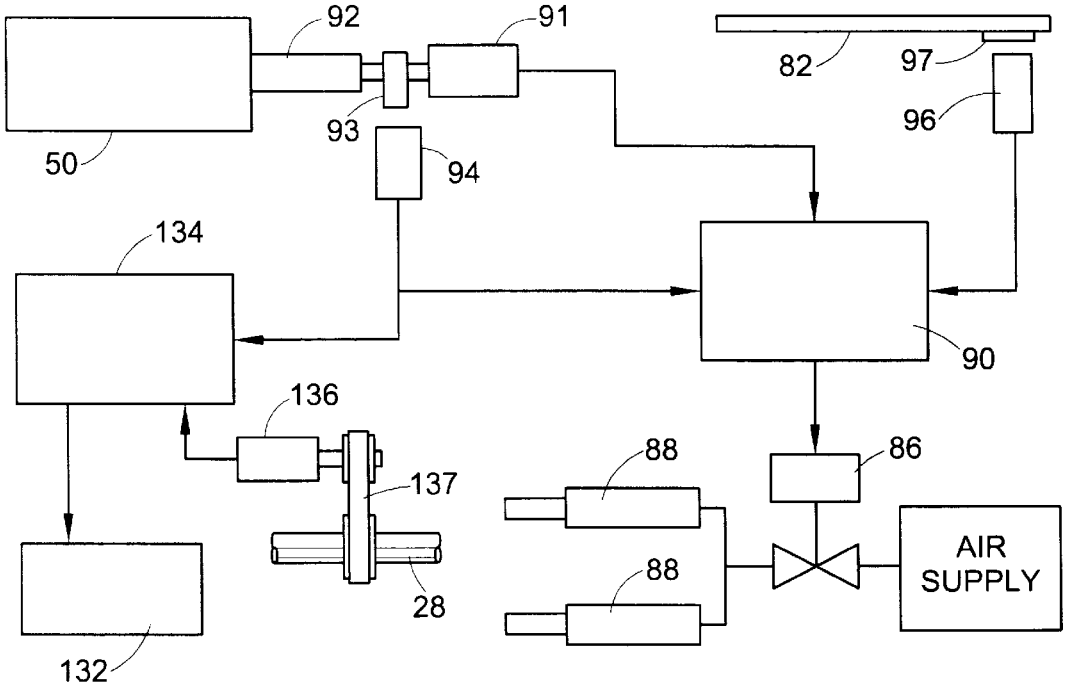
FIG. 4G is a schematic view of a control assembly for the inking units of the border print unit of FIG. 4A.

With reference now to FIG. 4E, the belt tensioning unit can comprise a tensioning roll 102 which is mounted on a horizontal traversing carriage 104 supported by the frame 100. The tensioning roll carriage is powered by an electric motor 106 mounted on the carriage 104. The motor 106 turns a longitudinally extending shaft 108 mounted on the carriage 104. The shaft has a pair of spaced gears 110 which mate with respective worm gears 112 on the carriage. The worm gears in turn engage Acme screws 114 that are fixed to the frame 100 to move the carriage 104 on the frame 100. The tensioning roll 102 is driven by another electric motor 116 through a gear reducer 117. A magnetic particle clutch 118 connects the output of the gear reducer to the tensioning roll 102.

Figure 4H:
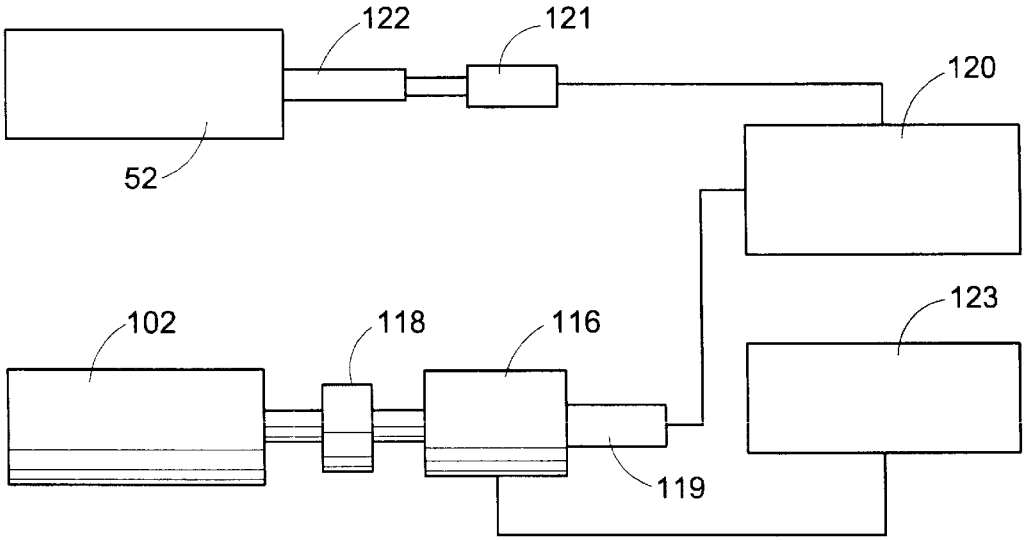
FIG. 4H is a schematic view of a control assembly for the belt tensioning roll of the border print unit of FIG. 4A.

With reference now to FIG. 4H, the tensioning roll 102 is electronically coupled to the register cylinder 52. To this end, the tensioning roll surface velocity is related to the surface velocity of the register cylinder. A first encoder 119 is provided on the motor 116 of the tensioning roll 102. The encoder 119 sends its information to a speed follower computer 120. A second encoder 121 senses the rotational speed of a journal 122 of the register cylinder 52. The signal from the encoder 121 is transmitted to the computer 120. The computer, in turn, regulates the speed of the motor 116 through a motor controller 123. The electronic interconnection of the motor 116 of the tensioning roll 102 and the register cylinder 52 enables very small controllable speed variations in the speed of the tensioning roll 102 resulting in fine control of the border belt tracking.

It should be appreciated that the border belt 82 is provided with a plurality of pinholes 124 (FIG. 4F) accurately punched along each side edge of the belt. These pinholes 124 register with pins 125 located around the circumference of the register cylinder 52 along its two side edges and solidly fixed thereto, as is evident from FIG. 4B. In this way, the register cylinder 52 positively drives the belt 82 at a set speed by friction and by registration of the pins 125 in the holes 124 of the belt 82.

With reference again to FIG. 4A, the border print unit also includes a pair of guide cylinders 126 and 127 around which the belt 82 is looped. These guide cylinders can also be provided with pin sprockets which register with the pinholes and the side edges of the belt 82 to locate the belt from side to side. However, these pin sprockets are mounted on sleeve bearings so that they are capable of rotating in relation to the circumference of their respective cylinders 126 and 127 as may be necessary. Such pin sprockets are identified by the numeral 128 on the cylinder 102 of FIG. 4E with the sleeve bearings being identified by the numeral 129. The belt 82 is positively driven by the register cylinder 52 and by the cylinders 126, 127 as well as the tensioning roll 102. The cylinders 126 and 127 are driven by a continuation of the gear train which also drives the inking units 68. The function of the cylinders, in addition to providing side guidance to the belt 82 by the pin sprockets as mentioned, is to permit the turning of the belt 82 by 90° in order to feed the belt to the tensioning roll 102 and to receive the belt from the tensioning roll and turn it approximately 90° into the frame 70. One of the turns must be made on the plate side of the belt. This is accommodated and offsetting is eliminated by relieving the roll 127 on which the plates ride and supporting the printing belt 82 in the gaps between the plates and on the non-printing part of the plates.

It should be appreciated that more or less than the twelve inking stations 68 could be mounted on the frame 70 as may be necessary. It should also be appreciated that the length of the belt 82 will be entirely dependent upon how many plates 83 it is desired to provide on the belt.

While the border print unit D is capable of printing in up to twelve different colors, as mentioned, it can print in less colors, if desired. It can also print in any chosen sequence. One cannot change the color sequence which is printed by a conventional color printing press without washing up the anilox rolls and the color rolls and reinking them with new color ink, if one wishes, for example, to switch from, e.g. orange to purple as the second color directly printed by a set of color rolls on a paper web. In contrast, in the present invention, the belt 82 is the transfer point of ink from the color rolls to the paper web 14. Because ink can be placed on the plates 83 of the belt in any sequence desired, by suitable actuation of the inking stations 68, one is able to print on the paper web in any color sequence without having to change the inks of the several color rolls.

The border print unit D is capable of printing in any color up to sixteen times in one revolution of the endless border belt 82. The system illustrated in FIG. 4A is capable of handling a border belt that is from thirty-two feet in length to sixty feet in length. Because one page of bingo paper is twenty-four inches long, the border belt can contain from sixteen pages through thirty pages of plates. By the use of repeating sequences of colors on the border belt, and by the use of plates with different bingo border designs on the same belt, it is possible to run books, i.e. collations of bingo paper, that repeat every two through thirty-six sheets. For example, to achieve a twenty-five page collation, the first twelve pages printed by the border belt 82 would be printed by solid border plates 83 and each page would be wetted with one of the twelve colors in the twelve inking units 68. The second twelve pages printed by the belt would be printed by border plates 83 with a different appearance and each of these pages would also be wetted by one of the twelve colors in the twelve inking units 68. The final single page would be printed by a plate 83 with yet another appearance and would be wetted with just one of the twelve colors in the twelve inking units. Using twelve different colors and three distinct style border plates will produce twenty-five unique appearing sheets, none of which have the same color and the same style border as any other sheet. In this connection, reference is made to a patent application entitled "Bingo Game Booklet" which is owned by the assignee of the present invention and which is being filed concurrently with the instant application. That application is incorporated herein by reference in its entirety.

Figure 5B:
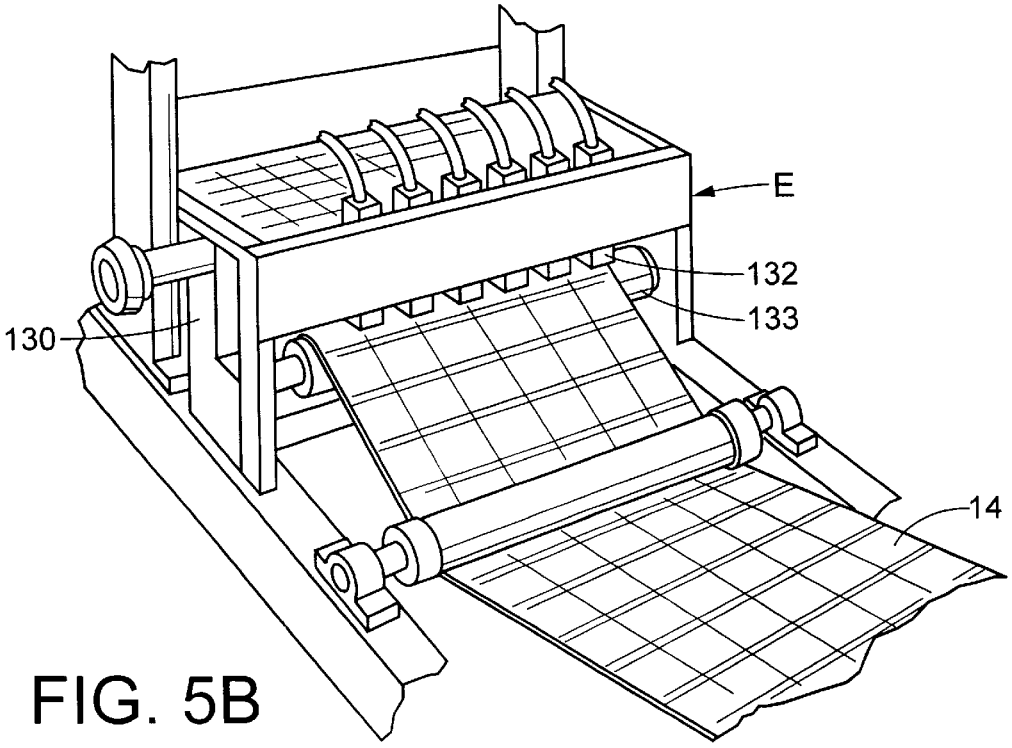
FIG. 5B is a schematic perspective view of the audit print unit of FIG. 5A.

With reference now to FIG. 5A, the printing system also comprises an audit number print unit E. As better shown in FIG. 5B, the audit number print unit E comprises a frame 130 on which are mounted a plurality of spaced ink jet heads 132, each of which print a desired string of alphanumerical digits on the web 14 running therepast. In FIG. 5B, it is illustrated that the web 14 is six bingo faces wide. Therefore, six such ink jet printheads 132 are provided, one for each of the bingo faces. These ink jet heads 132 are contactless and print variable data as desired as the web passes over an idler roll 133. In the preferred embodiment, they print audit numbers only on selected ones of the print areas defined on the web 14. More specifically, such audit numbers are printed only on the section of the web which will constitute the top sheet of each book. Printing only on the top sheet of the bingo book provides a cleaner looking bingo face, as there are no confusing multiple numbers on the same face and no numbers on faces on the following pages of the book.

With reference again to FIG. 4G, control for the ink jet heads 132 is provided by a conventional computerized ink jet controller 134 controlled by a 80386 or 80486 microprocessor. This receives information from a conventional encoder 136 coupled to a gear belt drive 137 from the main press line shaft 28. Further information for the ink jet computer 134 is obtained by the proximity sensor 94 which senses the flag 93 on the journal 92 of the impression cylinder 50.

With reference again to FIG. 5A, disposed between the audit number print unit E and the custom print unit F can be a main drive pulley 140 on the main line shaft 28. The main drive pulley is powered by a motor (not illustrated) via a belt (also not illustrated). The custom print unit F can be provided adjacent the audit number print unit E. The custom print unit can comprise a housing 142 which houses a conventional letter press print unit 144 that is driven by the main line shaft 28 through a gear box 146. A letter press unit is employed instead of an offset print unit at this location in order to ensure that the ink from the borders, which have now been printed on the web 14, does not get deposited on an impression cylinder of such offset print unit.

With reference now to FIG. 6A, the printing system according to the present invention also comprises a numbering unit G and a wax unit H. Both of these are housed in a single housing 150. The numbering unit G comprises a plurality of mechanical numbering heads 152 spaced from each other around the circumference of a print wheel 154. In the preferred embodiment, six such print wheels 154 are provided in a side by side relationship, one for each of the six bingo faces which are being printed in a side by side manner on the web 14. These numbering heads are electronically incremented sequentially. The paper web 14 is supported by an impression cylinder 156 (which can have a rubber blanket on it) as the numbering heads 152 print on the web.

Figure 6B:
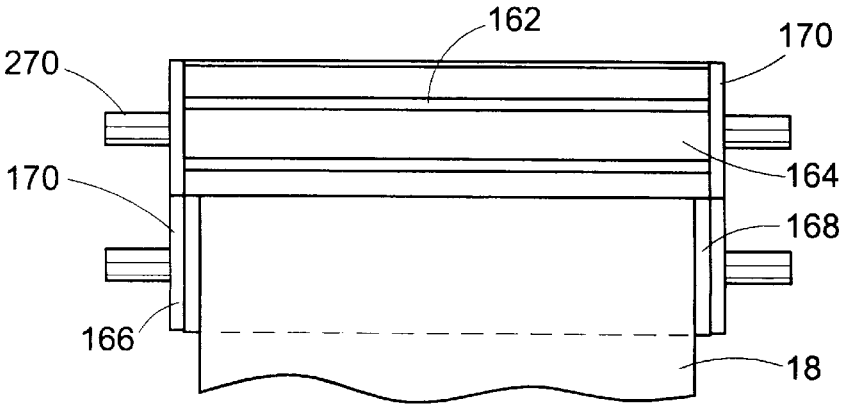
FIG. 6B is an enlarged side elevational view of a portion of the wax unit of FIG. 6A.

The wax unit H applies strips of wax on the part of the web which will form the top sheet of each bingo book. The wax coating allows a pad of books to be fanned open and separate from each other without having to employ separate wax sheets between the books, as in the prior art. The wax is applied by adjustable, preferably brass, bars 162, as shown in FIG. 6B. The bars 162 are held in a plate cylinder 164. An impression cylinder 166 over which the web 14 rides, has a rubber blanket 168 on its outer periphery to allow compression in the printing nip. Bearers 170 on each side of the impression cylinder 166 contact similar bearers on each side of the plate cylinder 164 in order to accurately control the printing pressure and, therefore, the quality of the wax impression. A wax which is resistant to glue is used for ease of separation of the padded books which are printed. It should be recognized that other glue repellent materials could be used instead of wax, such as PTFE sold under the mark TEFILON® or a suitable oil.

A variable speed motor 182 controls the rate at which wax is transferred from wax supply 184 by a conventional ducter type inker (not illustrated), which in this case transfers wax instead of ink, to the brass bars 162. The wax fountain roll speed is controlled by the variable speed motor 182 in order to reduce the speed to near 0 rpm and minimize wax buildup. Similarly, for the numbering unit G. a variable speed motor 186 controls the rate with which ink from an ink supply 188 is metered via another ducter type inker (not illustrated) to the numbering heads 152 in order to minimize ink buildup.

Figure 9:
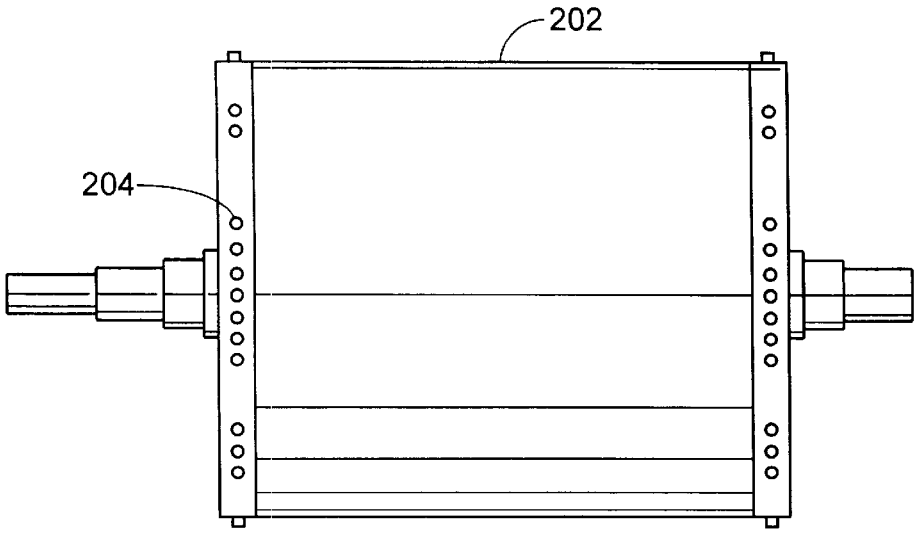
FIG. 9 is an enlarged top plan view of a print cylinder of the bingo face print unit of FIG. 7.
Figures 10A, 10B:
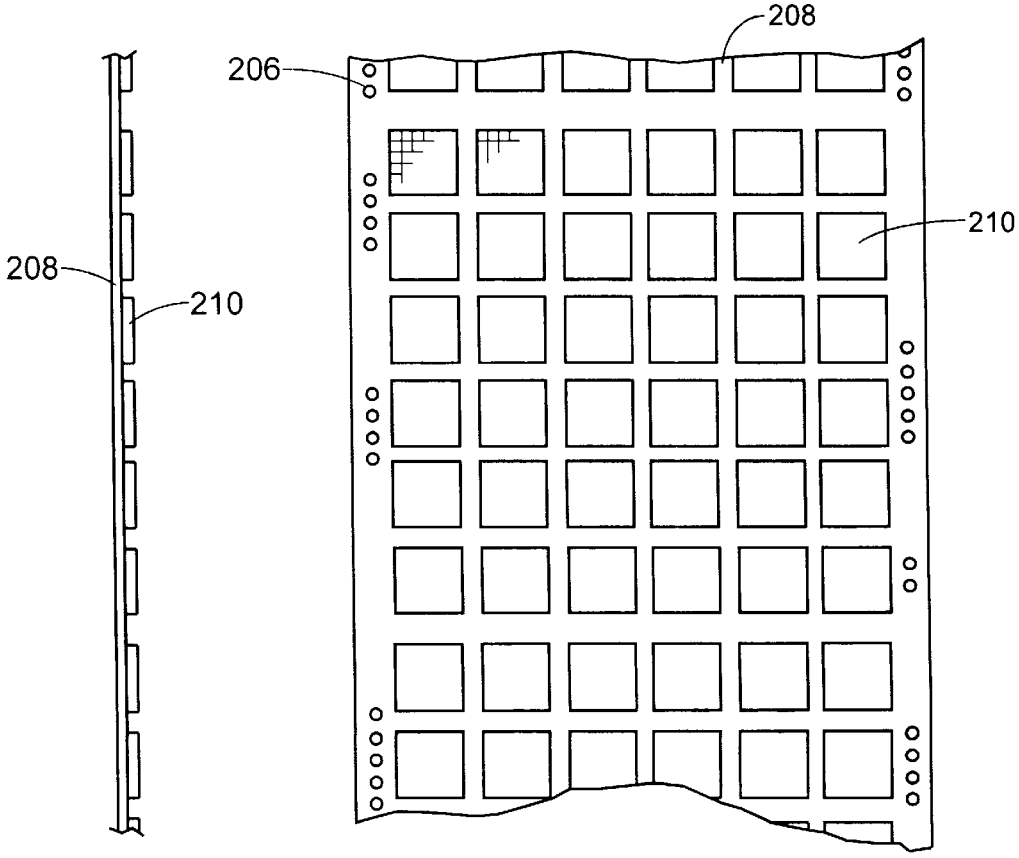
FIG. 10A is an enlarged developed view of a portion of a printing belt employed with the bingo face print unit.
FIG. 10B is a side elevational view of the printing belt of FIG. 10A.

With reference now to FIG. 7, the print system according to the present invention also comprises a bingo face print unit I. This unit comprises a housing 200 which rotatably supports a driving cylinder 202. With reference now to FIG. 9, the driving cylinder is provided along each side edge with a plurality of circumferentially spaced rigidly mounted pins 204. These pins engage in pinholes 206 provided along both side edges of a conventional bingo face printing belt 208 illustrated in FIG. 10A. Secured to the printing belt are a plurality of conventional printing plates 210. If desired, these plates can be secured to the belt 208 by means of double sided tape or the like as is known in the art. While a plurality of individual plates 210 are illustrated in FIGS. 10A and 10B, one for each bingo face which is to be printed, it should be appreciated that plates which each comprise six horizontally aligned bingo faces could be provided instead.

With reference again to FIG. 7, ink is applied to the belt 208 by an anilox roll 212. The anilox roll rotates through an ink chamber 214. A doctor blade 216 is located at the bottom of the ink chamber to control leakage, and a second doctor blade 218 is located at the top of the ink chamber to scrape off excess ink. If desired, the ink chamber can fold out for cleaning and doctor blade replacement.

Figure 8A:
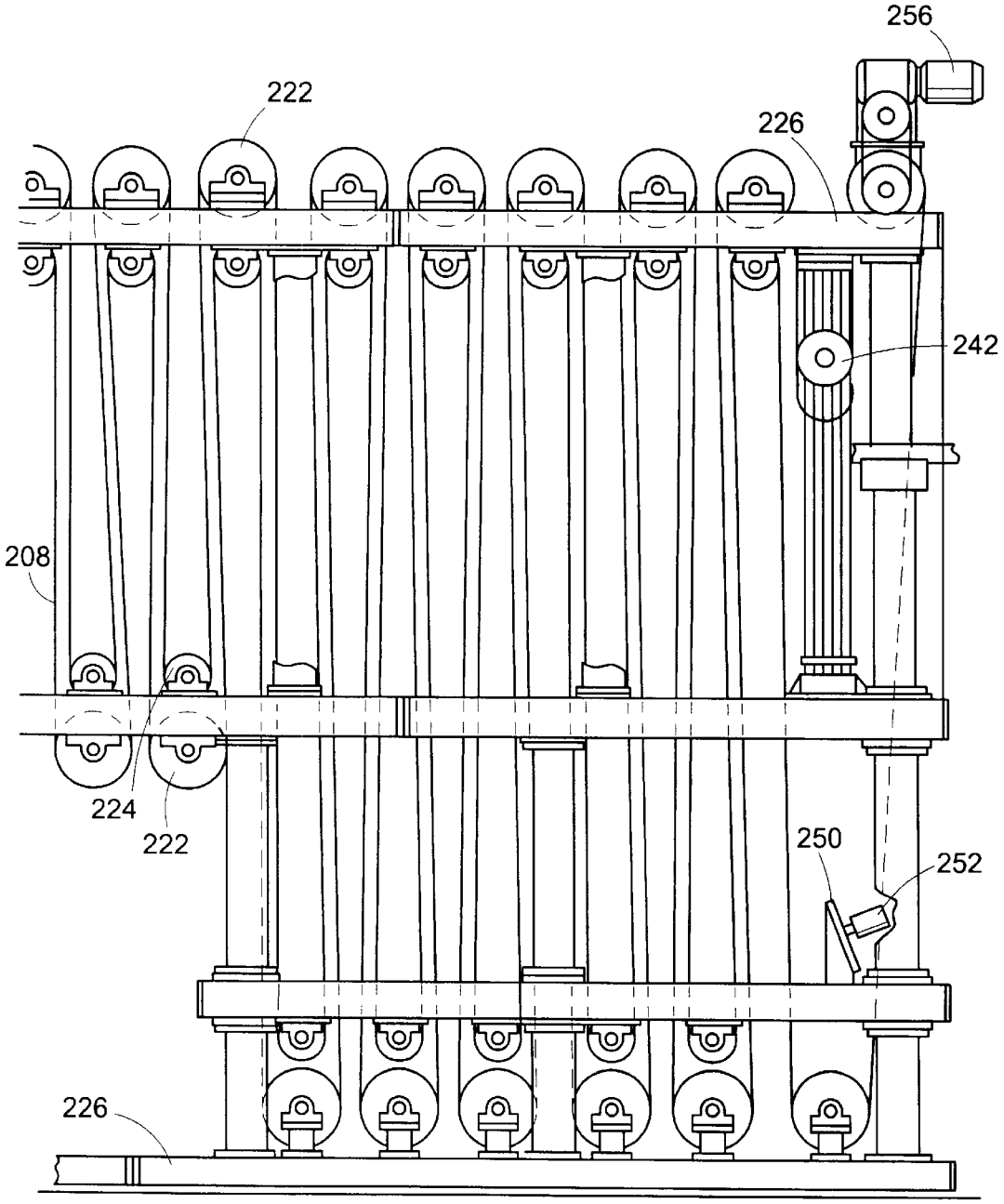
FIG. 8A is a schematic side elevational view of another portion of the bingo face print unit.
Figure 8B:
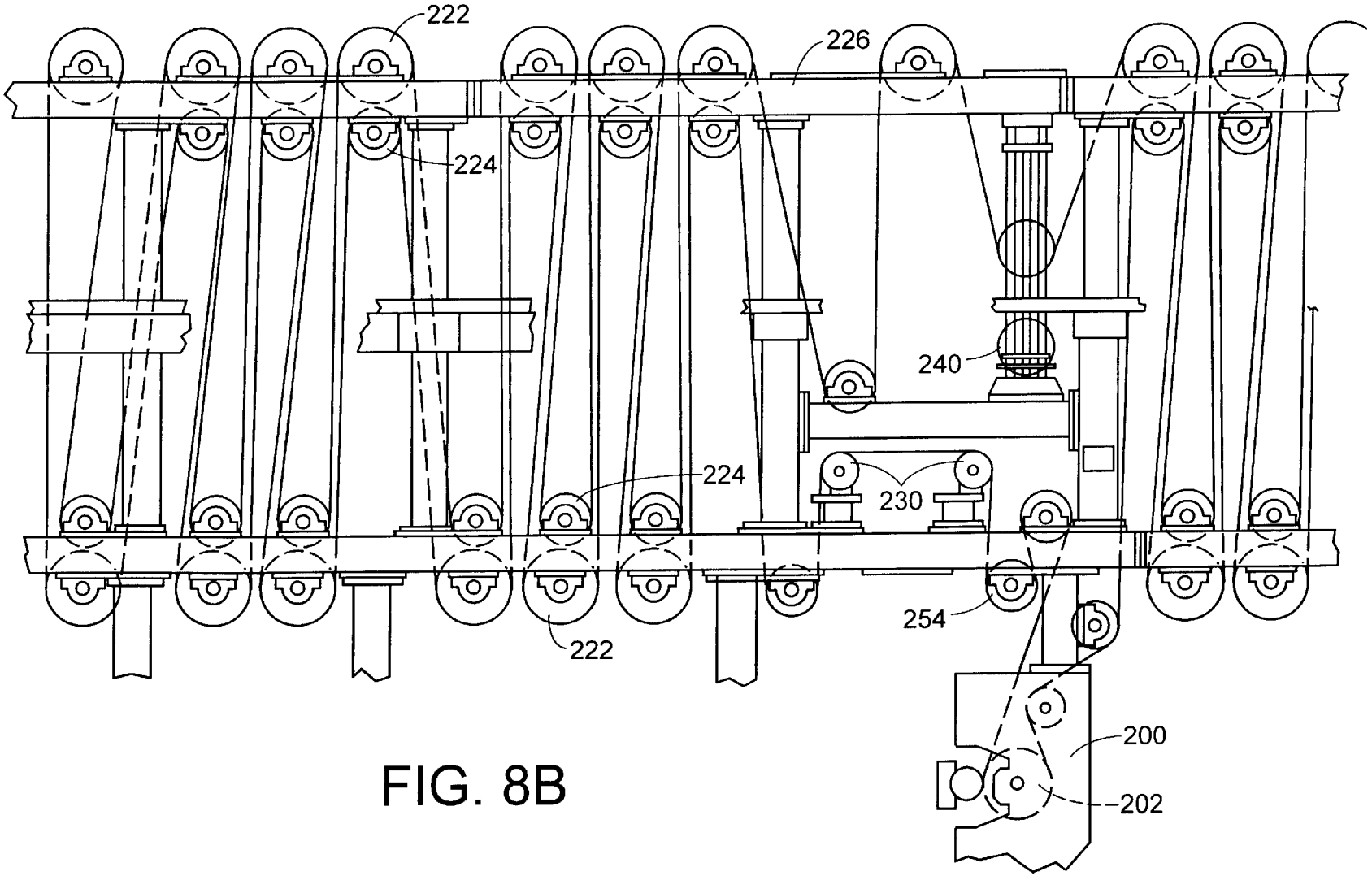
FIG. 8B is a schematic side elevational view of yet another portion of the bingo face print unit.

With reference now to FIGS. 8A and 8B, it can be appreciated that the printing belt 208 is long enough to be able to print all of the bingo faces in a series of 9,036 bingo faces. When printing 36 bingo faces on each page, the printing belt 208 will print all 9,036 bingo faces on 251 pages of the sheets cut from the web 14.

To understand the significance of a 251 page belt, it would be desirable to understand the functioning of a conventional 250 page bingo printing belt. A standard bingo series has 9,000 different bingo faces in a matrix of thirty-six faces per page. Dividing thirty-six bingo faces into the 9,000 faces in a series gives the numeral 250. This means that a 250 page belt is necessary in order to print 9,000 bingo faces where there are thirty-six faces printed on a page. Let us assume that one wishes to manufacture a book of bingo paper wherein each sheet of the book has a different color. As an example, let us choose a five page book in which the pages are, in order, blue, orange, green, yellow and pink. The current state of the art printing process would require that the 250 pages representing the 9000 bingo faces be separately printed on webs of paper in each of the five colors. The 250 pages for each of the five colors would be collated afterwards, off line.

In contrast, in the process according to the present invention, different border colors are sequentially printed on the same paper web 14. Then the bingo faces are printed on the web on the same printing line. For a 5 up book, the first page of bingo faces printed would be blue and, after one complete belt revolution of the border printing belt 82, blue would again appear on the first page of the second booklet produced. Because 250, the number of pages printed by the bingo face belt 208, is divisible by 5, the number of different pages printed by the border belt, the same bingo faces would again appear on the same colored border sheets a number of times. If 250 pages were provided on the bingo belt 208, identical bingo faces would appear in the same colored borders again. More specifically, producing a five page bingo booklet on a 250 page bingo face printing belt 208 without repositioning of the bingo face printing belt will yield only 50 unique booklets with the identical booklet being printed five times. This is because the number 250 is not a prime number. Rather, it is evenly divisible by the numbers 1, 2, 5, 10, 25, 50 and 250. But duplicate bingo faces are undesirable to bingo players and are, in fact, illegal in some states.

On the other hand, by using 251 pages for the bingo belt 208, i.e. 9,036 bingo faces, the blue would print on pages 1, 6, 11, 16, 21 . . . 241, 246, 251 for the first complete revolution of the bingo face printing belt 208 but would appear on pages 5, 10, 15 . . . 240, 245 and 250 for the second complete revolution of the belt. The third revolution would yield blue on pages 4, 9, 14. 239, 244, 249; the fourth, on pages 3, 8, 13 . . . 238, 243, 248; the fifth on pages 2, 7, 12 . . . 237, 242, 247 and then back to 1. In this way, every page of the bingo belt 208 is printed before an identical sheet is printed again. This occurs because the numeral 251 is a prime number such that it is divisible by no number other than itself and 1.

A prime number of printing pages on the bingo belt 208 allows a larger number of unique bingo booklets to be printed without stopping the printing press and repositioning the bingo belt. To take another example, producing a 10 UP 36 ON booklet, i.e. ten pages with each page having thirty-six bingo faces on a 251 page belt will yield 251 unique booklets, with each bingo face being repeated ten times but each time with a different border color. However, producing the same product on a 250 page belt without repositioning of the bingo face printing belt 208 will yield only twenty-five unique booklets. That is, each booklet would be repeated ten times.

Although using a prime number of bingo belt pages is advantageous, a prime number is not a requirement if the number of pages printed by the bingo belt 208 is not divisible by the number of pages printed by the border belt 82. For example, printing a booklet with 9 sheets will not result in duplicate booklets because 9 is not evenly divisible into 250. In addition, the number of pages printed by the bingo belt must not be divisible by a number which can be divided evenly into both the number of pages in the bingo book and the number of pages which can be printed by the bingo belt. For example, printing a 20 page bingo book on a 250 page bingo belt would not be acceptable because both the numeral 10 and the numeral 5 can be divided evenly into both numerals.

If the pages per booklet (Ups) and the number of printing pages on the bingo face printing belt 208 are relatively prime (that is, the least common multiple between the two numbers is just the product of the numbers), then the number of pages in each booklet gives the maximum number of times that the belt 208 can rotate before duplicating booklets. Therefore, the number of unique booklets per set of bingo booklets will also be maximized. However, if the ups and the number of pages on the belt 208 are not relatively prime, fewer unique booklets can be produced.

As an example, a 250 page printing belt has the prime factorization $2\times5^3$. If booklets with 19 pages each were to be produced, the the belt would be able to rotate 9 times before duplicate books would be produced since the prime factorization of 9 is 32, indicating that 250 and 9 are relatively prime to one another. Therefore, assuming that each printing page has 36 bingo faces, there would be $9\times36\times250=81{,}000$ faces in the complete set of bingo paper. However, if booklets with 10 pages each were to be produced, then the belt 208 would be able to rotate only 1 time before duplicate books would be produced since the prime factorization of 10 is $2\times5$, indicating that 250 and 10 are not relatively prime to one another. There would be only $1\times36\times250=9{,}000$ faces in the complete set of bingo paper. However, if the belt 208 were only 243 pages, then when printing a 10 up, the belt would be able to rotate 10 times, since $243=3^5$ is relatively prime to 10. When using the same belt for a 9 ups, the belt would only be able to rotate 1 time before duplicating booklets, since 9 and 243 are not relatively prime to one another. One possible solution is to use multiple bingo face printing belts when printing. For example, a 243 page belt for a 10 ups and a 250 page belt for a 9 ups, etc. This is extremely costly, involving the production of numerous belts as well as additional changeover time every time a different length booklet is printed.

The other solution is to have a prime number of pages on the bingo face printing belt 208. If the belt is composed of a prime number of pages, then, since a prime number is relatively prime to any number less than itself, the number of rotations of the belt before printing duplicate booklets will be maximized regardless of the number of pages in a booklet.

As an example, suppose the belt is 251 pages, with each page containing 36 bingo faces. When printing a 9 ups, the belt would be able to rotate 9 times before duplicating booklets and the set of bingo paper will contain 81,324 faces. When printing a 10 ups, the belt would be able to rotate 10 times before duplicating booklets and the set of bingo paper will contain 90,360 faces. This compares to 81,000 faces and 9,000 faces when using a 250 page belt for the 9 up and 10 up, respectively, or 8,748 faces and 87,480 faces for the 9 up and 10 up, respectively, when using a 243 page belt.

The tables below indicate the maximum number of revolutions of the web before printing duplicate booklets for both a 250 page belt and a 251 page belt.

| UPS | Number of revolutions between cycles 250 Page Web | Number of revolutions between cycles 251 Page Web |
|---|---|---|
| 1 | 1 | 1 |
| 2 | 1 | 2 |
| 3 | 3 | 3 |
| 4 | 2 | 4 |
| 5 | 1 | 5 |
| 6 | 3 | 6 |
| 7 | 7 | 7 |
| 9 | 9 | 9 |
| 10 | 1 | 10 |
| 11 | 11 | 11 |
| 12 | 6 | 12 |
| 13 | 13 | 13 |
| 14 | 7 | 14 |
| 15 | 3 | 15 |
| 16 | 8 | 16 |
| 17 | 17 | 17 |
| 18 | 9 | 18 |
| 19 | 19 | 19 |
| 21 | 21 | 21 |
| 22 | 11 | 22 |
| 23 | 23 | 23 |
| 24 | 12 | 24 |

As seen in the tables, a bingo face printing belt with a prime number of pages maximizes the number of rotations of the belt and therefore the number of unique booklets in the set of bingo booklets regardless of the number of pages in a bingo booklet. While multiple belts consisting of a non prime number of pages can increase the number of rotations for differ ent ups, this approach is not cost effective.

A prime number of sheets being printed by the bingo belt 208 allows the border colors printed by the border print belt 82 to cycle through the pages of the bingo printing belt without repeating a border color on a particular bingo face until the entire set of bingo paper is printed.

After the entire set is printed, the first page of the next set will again be in the first border color with the first bingo face thereon as in the previous set. In other words, the sets repeat so that the next set is now printed with the next set being identical to the first set in terms of bingo faces and border colors. However, for the next set, the numbering unit G indexes so that the next higher serial number is provided for this set of bingo paper.

Therefore, the use of a prime number for the number of pages of bingo faces which can be printed by the bingo face printing belt 208 maximizes the number of unique booklets in a set of bingo booklets regardless of the number of pages in each booklet. It also maximizes the number of unique faces that can be played simultaneously which can be printing using one bingo face printing belt. The use of a prime number minimizes the number of bingo face printing belts which need to be employed regardless of the number of pages in each bingo booklet.

Another common bingo face printed by conventional bingo belts is a 24 ON sheet, i.e. a sheet having twenty-four bingo faces. A conventional bingo belt for a 24 ON bingo face employs 375 pages. At 24 bingo faces per page times 375 pages, it can be seen that 9,000 unique faces are provided on such a conventional bingo belt. Using the present invention, a printing belt for such a bingo booklet would print 379 pages and would have 9,096 faces. Again, the reason for choosing 379 pages is that the numeral 379 is a prime number.

In order to save space, the printing belt 208 is preferably festooned. The belt 208 is therefore looped around a plurality of large diameter storage drums 222 and, nested therein, small diameter storage drums 224. These storage drums are held on a frame assembly 226. The large diameter storage drums 222 are driven at press speed in order to help drive the belt. The drums 222 are driven by a gear box (not illustrated) from the line shaft 28 and by belts 228 from drum to drum as shown in FIG. 8C.

The printing belt 208 needs to be tracked from side to side and must ride in the pins 204 of the printing cylinder 202. In order to aid the tracking and register of the belt 208 in relation to the drive cylinder 202, a pair of web alignment cylinders 230 are provided adjacent the drive cylinder 202 as can be seen in FIG. 5B to aid in belt tracking.

Figure 8C:
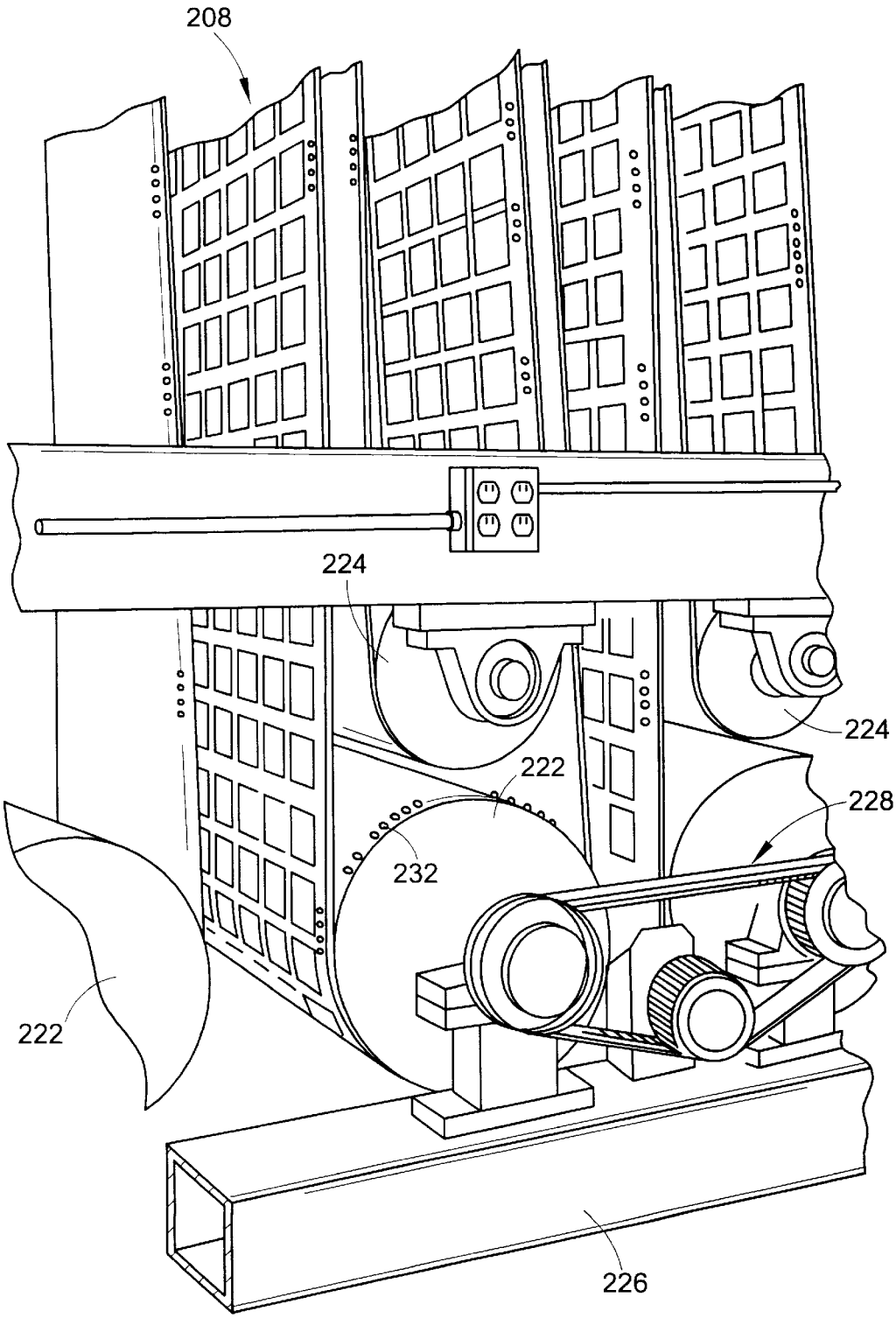
FIG. 8C is an enlarged perspective view of a portion of the bingo face print unit.

Some nine of the large diameter drums 222 can be provided with pin sprockets 232 on each end, as shown in FIG. 8C. These sprockets also help locate the belt from side to side. However, as these sprockets are mounted on bearings, relative movement is allowed between the cylinder and the sprockets, thus allowing for a slight speed differential between the belt and the cylinder. Belt tensioners are preferably provided in two locations in the festoon. A first tensioner 240 (FIG. 8B) adjusts the tension of the belt going into the print cylinder. A second tensioner 242 (FIG. 8A) is provided in order to allow slack at the far end of the festoon for belt splicing.

Provided at the far end of the festoon is a belt splicing table 250 and a clamp 252. The table 250 holds and locates the belts so that the ends thereof can be taped together. The clamp 252 provides pressure to ensure maximum holding power for the tape used for splicing.

With reference again to FIG. 8B, a conditioning drum 254 follows the belt aligner. This drum is driven through a magnetic particle clutch (not illustrated) to provide an additional and adjustable drive for the printing unit. The clutch will slip if the belt is being pulled into the printing nip faster than the clutch is driving the belt.

With reference now again to FIG. 8A, a belt threading motor 256 is provided to turn the belt festoon for installing the belt. When this drive is used, the belt unit is declutched from the rest of the press at the printing cylinder 202.

The printing belt 208 is, as mentioned, looped around the driving or print cylinder 202. This cylinder is located adjacent an impression cylinder 258 around which the paper web 14 is looped. Both the print cylinder 202 and the impression cylinder 258 are driven by the main drive shaft 28 through suitable conventional gear boxes, much like the gear boxes illustrated in FIG. 4A in connection with the border print unit. As the paper web 14 travels around the impression cylinder 258, it is brought into contact with the printing belt 208 and the bingo printing plates 210 thereon print bingo faces on the web. It should be appreciated that the printing belt 208 prints the bingo faces between the borders which have been printed on the web 14 by the border belt 82.

Figure 11:
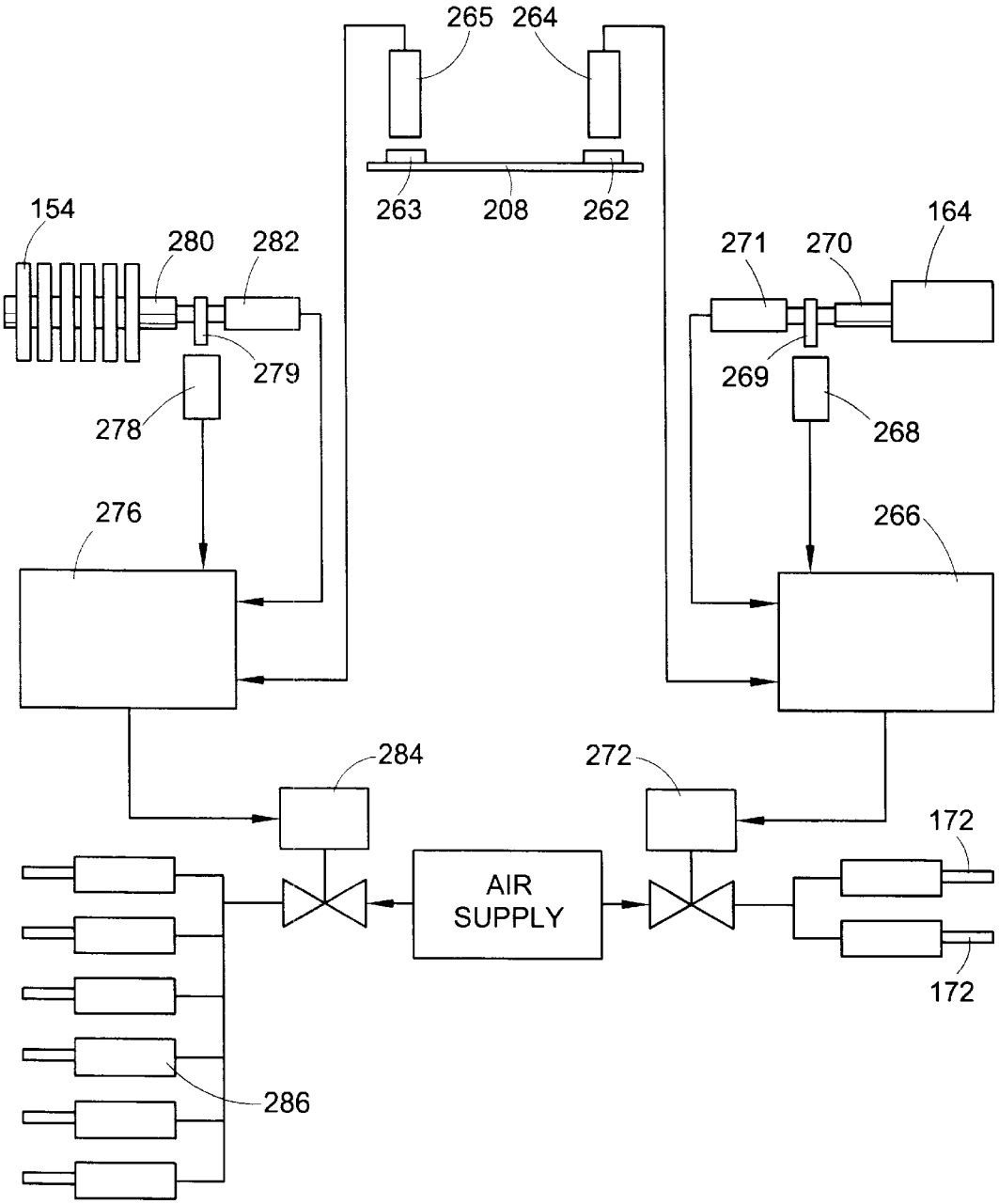
FIG. 11 is a schematic view of a control assembly for the numbering unit and the wax unit of the printing system; and, FIG. 12 is a schematic side elevational view of a cutting unit for the printing system according to the present invention.

With reference now to FIG. 11, a pair of metal tape strips 262 and 263 are provided on respective sides of the bingo face belt 208 at a desired location thereon. A respective one of these strips is sensed by a respective conventional proximity sensor 264 and 265, which can be of the same type as the sensor 96. The first proximity sensor 264 feeds its information to a conventional wax unit controller 266. Additional information to the controller 266 is provided by a conventional proximity sensor 268 which senses the presence of a flag 269 positioned on a journal 270 of the wax plate cylinder 164. Further information to the wax unit controller is provided by a conventional encoder 271 on the journal 270. The wax unit controller then selectively actuates a conventional solenoid operated air valve 272 which supplies pressurized air to the cylinders 172 which move the wax unit impression cylinder 166. In this way, the number of press revolutions is counted and the impression cylinder 166 is thrown on and off at the appropriate time so that only those sections of the web 14 which will be the top sheets in each book will have the wax coating applied thereto.

The proximity sensor 265 supplies information to a conventional numbering unit controller 276. Additional information to the numbering unit controller is provided by a conventional proximity sensor 278 which senses the presence of a flag 279 positioned on a numbering unit shaft 280. Additional information to the numbering unit controller is provided by a conventional encoder 282. The numbering unit controller, in turn, switches a conventional solenoid operated air valve 284. The air valve selectively supplies pressurized air to a plurality of air cylinders 286. The air cylinders are employed to increment the mechanical number printer which prints a serial number on each bingo face. As is known in the art, the six mechanical numbering heads 152 are mounted on each print wheel 154 and six such print wheels are provided to print a serial number for each of a 6 by 6 matrix of bingo faces. The numbering heads are indexed by throwing a cam on the ring. The numbering unit is conventional and will not be further described herein. As mentioned previously, it is an object of the present invention to provide the same serial number on each and every printed bingo face in a series of bingo faces being printed on the web. These serial numbers are used to enable a proprietor of the game to prevent players from declaring a bingo using paper which was not purchased at the beginning of the bingo session.

These numbers would normally increment after one revolution of the bingo face printing belt 208. However, for the present invention, the numbering units are only incremented after the bingo belt 208 revolves as many times as there are sheets in the bingo book. In other words, if it is contemplated that twenty-five sheets be printed in a booklet, i.e. that it be a 25 UP booklet, then the numbering unit would only increment after twenty-five revolutions of the bingo belt 208.

The several proximity sensors, encoders and computers mentioned with regard to FIG. 11 are preferably of the same type as mentioned previously in connection with the computers, proximity sensors and encoders described in FIGS. 4G and 4H.

As the now completely printed web 14 exits the bingo face unit I, it enters a turn bar 288. Such turn bars are conventional in web printing.

With reference now to FIG. 12, the web 14 then enters a conventional cutting unit J. The cutting unit includes a housing 290 in which is located a silicone unit 292 over which the web 14 passes. The silicone unit lightly coats the back side of the web 14, i.e. the non-printed side thereof, with a silicone material. The silicone aids in allowing the sheets which are cut from the web to slide in relation to each other. After passing the silicone unit 292, the web 14 approaches a bed knife 294 and a cooperating fly knife 296 which is secured on a rotating fly knife cylinder 298. The two knives cooperate to cut the web at preselected longitudinally spaced locations as the cylinder 298 rotates in order to create sheets 300 bingo paper from the web. After the sheets are cut, they are forwarded by a pair of high speed tapes 302 and 304 and then encounter a slowdown tape 306. The slowdown tape feeds the sheets to a skid 308 on which the sheets are accumulated. Subsequently, one edge of the now stacked sheets can be coated with a suitable adhesive material by conventional means, as is known in the art to secure the sheets to each other. This forms a plurality of collated bingo sheet booklets which can be broken away from each other at the wax stripes located on the top sheet of each booklet.

The invention has been described with reference to preferred embodiment. Obviously, modifications and alterations will occur to others upon a reading and understanding of the preceding detailed description. It is intended that the invention be construed as including all such modifications and alterations insofar as they come within the scope of the appended claims or the equivalents thereof.

We claim:

1. A method of printing on a web of paper, comprising the steps of:

providing a web of paper;

sequentially printing each of a plurality of different indicia on defined sequential longitudinally spaced printing fields on said web of paper, wherein said step of sequentially printing each of a plurality of indicia comprises the subsidiary steps of:

printing a first pattern sequentially in each of a plurality of colors, and printing a second pattern sequentially in each of the plurality of colors in tandem with the first pattern; and, printing information in each of the defined printing fields on the web of paper.

2. The method of claim 1 wherein said step of printing information comprises the subsidiary steps of:

printing a first designation in each of said defined printing fields on said web of paper; and, printing a matrix of alphanumeric characters in each of the defined printing fields on the web of paper.

3. The method of claim 1 further comprising the step of printing a second designation on preselected ones of the defined sequential printing fields on said web of paper.

4. The method of claim 1 further comprising the step of applying a glue repellent coating to at least portions of preselected ones of said defined printing fields on said web of paper.

5. The method of claim 1 further comprising the step of printing a third pattern in at least one color in tandem with the first pattern and the second pattern.

6. The method of claim 1 further comprising the step of repeating said steps of printing in a first pattern and printing in a second pattern.

7. The method of claim 1 further comprising the step of cutting the web into predetermined lengths after said step of subsequently printing information.

8. A method of printing bingo sheets on a web of paper wherein each sheet has at least one bingo face which is designated by an indicium that is different from an indicium designating a bingo face of each adjacent sheet, comprising the steps of:

providing a web of paper;

sequentially printing a plurality of different bingo matrix indicia on defined sequential longitudinally spaced areas on said web of paper, wherein said step of sequentially printing a plurality of different bingo matrix indicia comprises the subsidiary steps of:

printing each of a plurality of indicia having a common first pattern, and subsequently printing each of a plurality of indicia having a common second pattern;

employing a single printing nip for the step of sequentially printing; and, printing bingo matrices in each of said defined areas on said web of paper, wherein said steps of printing indicia having a common first pattern and indicia having a common second pattern each comprise the subsidiary step of printing at least one design in each of a plurality of different colors.

9. The method of claim 8 further comprising the step of printing an identifying numeral in each of said defined sequential areas on said web of paper.

10. The method of claim 8 wherein said step of printing bingo matrices comprises the step of printing at least two bingo matrices in a side by side arrangement on the web.

11. The method of claim 8 wherein said step of sequentially printing a plurality of different bingo matrix indicia comprises the subsidiary step of printing a plurality of different borders which will each extend around at least a portion of a circumference of a bingo matrix printed during said step of printing bingo matrices.

12. The method of claim 8 further comprising the step of printing an audit number on preselected ones of said sequential areas on said web of paper.

13. The method of claim 8 further comprising the step of applying a glue repellent coating to at least portions of preselected ones of said sequential areas on said web of paper.

14. The method of claim 8 further comprising the step of cutting the web into predetermined lengths after said step of subsequently printing information.

15. A method for printing bingo game booklets comprising the steps of:

providing a web of paper;

defining discrete areas on the web;

sequentially printing a bingo matrix identifier in each of a plurality of colors on the discrete areas on the web of paper, wherein said step of sequentially printing a bingo matrix identifier comprises the subsidiary steps of:

printing in each of a plurality of colors in a first pattern, and subsequently printing in each of a plurality of colors in a second pattern;

printing bingo matrices in each of the discrete areas on said web of paper;

cutting the web into a plurality of master bingo sheets; and, stacking the plurality of master bingo sheets into a stack.

16. The method of claim 15 further comprising the step of printing an identifying numeral in each of the discrete areas on the web of paper.

17. The method of claim 15 wherein said step of printing bingo matrices comprises the step of printing at least two bingo matrices in a side by side arrangement on the web.

18. The method of claim 15 wherein said step of sequentially printing a bingo matrix identifier comprises the subsidiary step of printing a border which will extend around at least a portion of a circumference of the bingo matrix printed during said step of printing a bingo matrix.

19. The method of claim 15 further comprising the step of printing an audit number on preselected ones of the defined sequential areas on the web of paper.

20. The method of claim 15 further comprising the step of applying a glue repellent coating to at least portions of preselected ones of the defined sequential areas on the web of paper.

21. The method of a claim 15 further comprising the step of subsequently printing in each of a plurality of colors in a third pattern.

22. The method of claim 21 further comprising the step of separating the master stack of booklets at predetermined locations to form individual booklets, wherein each sheet of each booklet is printed either in a different color or a different pattern from each other sheet in the booklet.

23. The method of claim 22 further comprising the step of stacking the master sheets in a predetermined sequence so that every booklet produced has the same sequence of sheets.

24. The method of claim 21 further comprising the step of insuring that no two booklets have sheets with the same bingo faces printed in the same color and same pattern.

25. The method of claim 15 further comprising the step of adjusting a tension on the web of paper.

26. A method of printing bingo game booklets comprising the steps of:

providing a web of paper;

sequentially printing a plurality of different bingo matrix indicia on defined sequential longitudinally spaced areas of said web of paper, wherein said step of sequentially printing a plurality of different bingo matrix indicia comprises the subsidiary steps of printing each of a plurality of indicia having a first common pattern and sequentially printing at least one additional plurality of indicia with a second common pattern in tandem with the first pattern;

employing a single printing nip for the step of sequentially printing;

printing bingo matrices in each of said defined areas on said web of paper; and, forming the web into a plurality of bingo booklets, each booklet having a minimum of thirteen pages and employing indicia printed in at least two different patterns.

27. The method of claim 26 wherein each of a plurality of indicia is printed in a common second pattern.

28. The method of claim 26 wherein twelve indicia are printed in a common first pattern and twelve indicia are printed in a common second pattern.

29. The method of claim 28 further comprising the step of subsequently printing in at least one of a plurality of indicia having a common third pattern in tandem with the first and second patterns.

* * * * *